US012685401B2

(12) United States Patent
Bernetich

(10) Patent No.: US 12,685,401 B2
(45) Date of Patent: Jul. 21, 2026

(54) COLLAPSIBLE AND POP UP LOCK BOX WITH MOUNTABLE STORAGE CONTAINER AND TETHER

(71) Applicant: Dylan Jackson Bernetich, Nashville, TN (US)

(72) Inventor: Dylan Jackson Bernetich, Nashville, TN (US)

( * ) Notice: Subject to any disclaimer, the term of this patent is extended or adjusted under 35 U.S.C. 154(b) by 0 days.

(21) Appl. No.: 18/954,643

(22) Filed: Nov. 21, 2024

(65) Prior Publication Data

US 2025/0169638 A1 May 29, 2025

Related U.S. Application Data

(60) Provisional application No. 63/602,496, filed on Nov. 24, 2023.

(51) Int. Cl.
*A47G 29/20* (2006.01)
*A47G 29/30* (2006.01)

(52) U.S. Cl.
CPC ..... *A47G 29/20* (2013.01); *A47G 29/30* (2013.01)

(58) Field of Classification Search
CPC ..... A47G 29/20; A47G 29/22; A47G 29/30; A47G 29/141; A47G 29/1223; A47G 2029/144; B65D 21/086; D06F 95/004
USPC ..... 232/30–32
See application file for complete search history.

(56) References Cited

U.S. PATENT DOCUMENTS 358,632 A * 3/1887 Teller ..... A47G 29/1207 232/32
378,955 A * 3/1888 Dubey ..... A47G 29/1207 193/8
1,027,524 A * 5/1912 Cook ..... A47G 29/1207 383/22
1,451,343 A * 4/1923 Panagopolous .... A47G 29/1207 383/7
1,838,801 A * 12/1931 Anderson ..... A47G 29/1207 232/32
2,421,221 A * 5/1947 Rothe ..... B07C 7/04 232/30
2,468,897 A * 5/1949 Rothe ..... B65D 29/00 383/103
4,785,960 A * 11/1988 Belisle ..... A47G 29/20 383/22
5,624,071 A * 4/1997 Sosan ..... A47G 29/20 232/29
6,026,662 A * 2/2000 Schlipper ..... A45C 3/001 70/59
6,244,081 B1 6/2001 Schlipper
6,527,136 B1 3/2003 Sabounjian
6,662,997 B1 * 12/2003 Smith ..... A47G 29/1216 232/29
7,069,753 B2 7/2006 Schlipper
9,156,592 B1 * 10/2015 Smith ..... B65D 33/165
9,161,596 B2 10/2015 Schlipper (Continued)

*Primary Examiner* — William L Miller
(74) *Attorney, Agent, or Firm* — Michael A. Blake

(57) ABSTRACT

A system to protect delivered items, the system comprising: a storage container, a collapsible lock box container; a tether attached to the storage container and the collapsible lock box container; where the collapsible lock box container is configured automatically deploy from a folded stored configuration when inside the storage container, to a unfolded configuration ready to accept a delivered item when removed from the storage container.

10 Claims, 29 Drawing Sheets

(56) References Cited

U.S. PATENT DOCUMENTS 9,408,450 B2 8/2016 Schlipper
9,629,423 B2 4/2017 Schlipper
10,076,204 B1 * 9/2018 Sadeghi ..... A47G 29/141
10,131,478 B2 * 11/2018 Maser ..... E05B 65/52
10,143,320 B1 * 12/2018 Batts ..... A47G 29/16
10,264,906 B2 * 4/2019 Bloom ..... G06Q 20/322
10,282,951 B1 * 5/2019 Kulick ..... A47G 29/141
10,321,780 B1 * 6/2019 James ..... A47G 29/141
10,743,695 B1 * 8/2020 Altmaier ..... B60R 9/065
11,253,096 B2 * 2/2022 Bartley-Clark ..... A47G 29/30
11,406,212 B2 * 8/2022 Odeh ..... A47G 29/141
11,412,876 B1 * 8/2022 Kadlub ..... A47G 29/20
11,825,972 B2 * 11/2023 Grijalva ..... A47G 29/141
11,889,937 B2 * 2/2024 Meddah ..... G08B 3/1016
11,944,217 B1 * 4/2024 Sutherland ..... A47G 29/20
12,133,604 B2 * 11/2024 Courtney ..... A47G 29/141
12,137,827 B2 * 11/2024 Jenkins ..... A47G 29/141
12,193,585 B2 * 1/2025 de Jonge ..... A47G 29/20
12,329,303 B1 * 6/2025 McNaboe ..... A47G 29/30
12,465,164 B1 * 11/2025 Fischer ..... A47G 29/141
2003/0110818 A1 * 6/2003 Schlipper ..... A45C 13/18
70/64
2012/0269461 A1 * 10/2012 Proctor ..... G09F 23/00
383/42
2013/0077896 A1 * 3/2013 Wiley ..... B65D 33/28
383/86.2
2014/0353322 A1 * 12/2014 Kellogg ..... D06F 95/004
220/666
2016/0051073 A1 * 2/2016 Heinz ..... A47G 29/141
232/39
2016/0068306 A1 * 3/2016 Heinz ..... B65D 85/70
220/6
2016/0167832 A1 6/2016 Butler
2017/0055751 A1 * 3/2017 Sundaresan ..... E05B 45/005
2017/0127868 A1 * 5/2017 Adewuyi ..... A47G 29/22
2018/0162612 A1 * 6/2018 Bojic ..... B65D 33/2516
2018/0202199 A1 * 7/2018 Critz ..... E05B 73/0005
2018/0228311 A1 * 8/2018 Bloom ..... G06Q 20/322
2019/0104876 A1 * 4/2019 Loures ..... E05B 73/00
2019/0133362 A1 * 5/2019 Gilligan ..... A47G 29/20
2019/0223644 A1 * 7/2019 Hopp ..... A47G 29/20
2019/0231104 A1 * 8/2019 Dunkelberger ..... A44B 19/30
2020/0060460 A1 * 2/2020 Farrar ..... A47G 29/141
2020/0107663 A1 * 4/2020 Eivaz ..... A47G 29/141
2021/0045563 A1 * 2/2021 Bartley-Clark ..... A47G 29/141
2021/0282581 A1 * 9/2021 Odeh ..... A47G 29/141
2021/0298507 A1 * 9/2021 Grijalva ..... A47G 29/20
2022/0183491 A1 * 6/2022 Cooper ..... A47G 29/20
2022/0233010 A1 * 7/2022 Sundaresan ..... G08B 13/1463
2022/0395124 A1 * 12/2022 Meddah ..... G08B 13/1463
2023/0029102 A1 * 1/2023 de Jonge ..... A47G 29/141
2023/0157472 A1 * 5/2023 Barkman ..... A47G 29/20
232/1 R
2023/0322456 A1 * 10/2023 Parks ..... B65D 55/14
220/210
2023/0329469 A1 * 10/2023 Alvarez Garcia ..... A47G 29/22

* cited by examiner

COLLAPSIBLE AND POP UP LOCK BOX WITH MOUNTABLE STORAGE CONTAINER AND TETHER

CROSS-REFERENCES

This patent application claims priority to provisional patent application No. 63/602,496, filed on Nov. 24, 2023, by Dylan Jackson Bernetich and entitled "COLLAPSIBLE AND POP UP LOCK BOX WITH MOUNTABLE STORAGE CONTAINER AND TETHER" which provisional application is fully incorporated by reference herein.

TECHNICAL FIELD

The present invention relates to a collapsible and pop up lock box with a mountable storage container and tether, and more specifically relates to a collapsible and pop up lock box with a mountable storage container and tether for damage mitigation, weather protection, and theft deterrence of delivered packages.

BACKGROUND

In the package delivery industry there are many challenges that inhibit the package delivery process. Delivery drivers have to complete their delivery within a small window of time. This creates a time constraint for any product used by delivery drivers. To reduce waste and use of excess cardboard and plastics, packages may start to be delivered without any protective packaging. This exposes them to the elements which can increase the risk of damage from weather related elements and can increase the roadside visibility which will reduce consumers' privacy along with creating increased opportunities for theft. The average value of stolen packages ranges anywhere from $50-$200 U.S. dollars depending on the study. Research in this area has continued to increase and has become rich in data with numerous larger shipping companies actively trying to solve this problem of package theft and damage, as this is a cost that falls into the laps of either the consumer or the delivery companies. The data collected on risk inevitably allows package delivery services to understand the extent of the risks that they face. This is over an 8 billion U.S. dollar issue with over 260 million packages stolen every year.

The current field of inventions and solutions is not focused on the problem at hand. The issue is not necessarily theft prevention but theft deterrence. Currently, this field offers a variety of solutions to this problem with a plethora of designs and sizes for package delivery. Some lock boxes range from smaller box sizes placed near front doors of occupancies or offices, to large chest freezer shaped fixed objects to place packages into. These large physical objects occupy a large amount of space. Because of the materials used by these inventions the price can range over $500 dollars for package lock boxes. Not only are these products and inventions increasingly expensive, but they can also take up valuable real estate on one's front porch and can be an eyesore to the property owners or renters.

There are persistent issues of package theft and weather-related damage in the residential and commercial package delivery industry. The rise of e-commerce has led to an increase in deliveries, where packages are often left unattended on doorsteps or porches. This exposes them to theft, which is primarily a crime of opportunity, as well as potential damage from environmental factors such as rain, snow, and wind.

Current delivery practices and environmental initiatives by shipping companies, which seek to reduce protective packaging, have only heightened the risks. Additionally, in store pickup is increasingly becoming available at the cost of convenience to the consumers who have ultimately become tired of failed delivery attempts and package thefts. The solutions present today fail to address the core issue of opportunistic theft in a practical, user-friendly, and cost-effective way that provides convenience and security to the delivery process.

Another common solution involves surveillance cameras or doorbell cameras that monitor deliveries. However, while these devices may help identify theft after it occurs, they do little to deter thieves. In the majority of cases, these solutions are reactive rather than preventative, as they do not physically secure the package.

Other methods include relying on special delivery instructions, such as asking delivery drivers to hide packages in less visible locations or using decoys or signs to deter thieves. However, these approaches are unreliable, as they depend on human compliance and do not always protect packages from environmental damage.

Additionally, smart lockers or secure drop-off services, such as those provided by retail giants or local delivery companies, are emerging as solutions, but they require significant infrastructure investment, are primarily limited to urban or commercial settings, and are inconvenient to customers. These options are not readily available for individual residential use and typically do not address the needs of suburban or rural customers.

Overall, the current methods either fail to provide comprehensive security, are too expensive or impractical for widespread adoption, or only address part of the problem.

Thus there is a need for a collapsible and pop up lock box with a mountable storage container and tether that overcomes the above-listed and other disadvantages.

SUMMARY OF THE INVENTION

The invention relates to a system to protect delivered items, the system comprising: a storage container; a collapsible lock box container; a tether attached to the storage container and the collapsible lock box container; where the collapsible lock box container is configured automatically deploy from a folded stored configuration when inside the storage container, to a unfolded configuration ready to accept a delivered item when removed from the storage container.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 2:
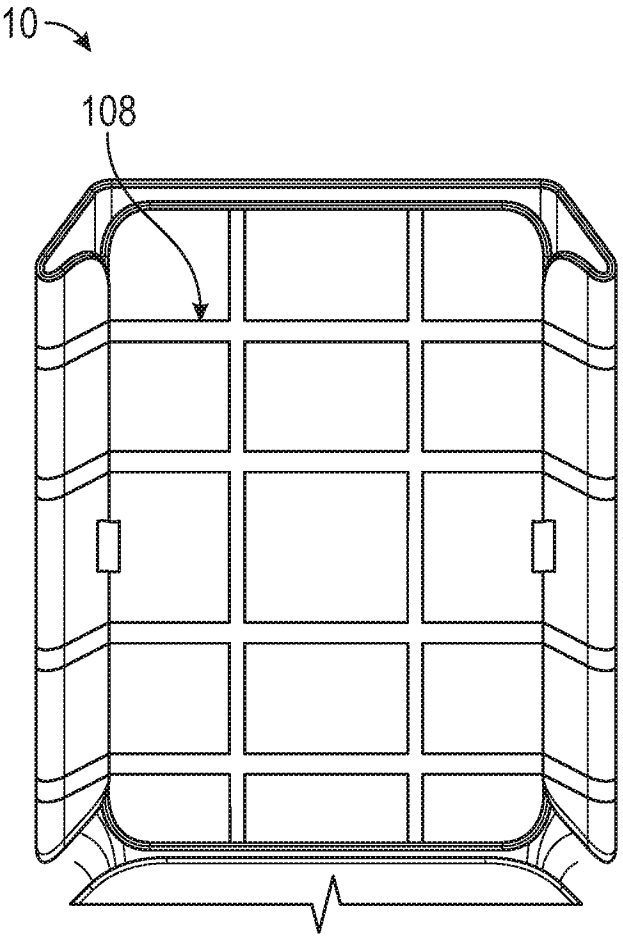
FIG. 2 is a cross sectional view of the collapsible lock box container.

The terminology used herein is for the purpose of describing specific embodiments only and is not intended to be limiting of the inventions functionality and alternate functionality. Unless otherwise defined, all terms used herein have the same common meaning to those with ordinary skills in the art to which this invention belongs.

In describing the invention in detail, it is understood that various techniques and steps are disclosed. Each of these have individual benefits and each can also be used in conjunction with one of the other disclosed techniques in order to best serve the product's quality and ensure most efficient manufacturing processes. For clarity, this description will refrain from repeating every possible combination of the individual steps in an unnecessary fashion. It should be understood that the detailed description of the invention and claims should be read with the understanding that such combinations are entirely within the scope and spirit of the invention and the claims made.

For purposes of explanation, numerous specific details are in order to provide a clear understanding of the present invention. It will be evident to those skilled in the art, that the present invention may be conceptually understood without these specific details. This disclosure is to be considered as an example and is not intended to limit the invention to the specific illustrations within this application along with the description below.

The invention relates to lock boxes that may be used by both those who receive parcels and those who deliver parcels.

The invention is designed to solve various problems by providing a collapsible, weather-resistant, and cut-resistant lockbox system that is compact, easy to store, and deployable only when needed. It also offers secure tethering to the property, preventing theft while preserving valuable space and maintaining a property's visual appeal. This invention combines convenience, security, and affordability to meet the need for package protection for homeowners, apartment dwellers, and small businesses alike.

The present invention comprises of a novel pop up collapsible weather resistant lock box container with a mountable storage container and tether.

This novel invention for package lock boxes provides a secure, economic, resourceful, and fast solution. In short, this is a stowable pop up lock box used to conceal and protect packages from theft and weather that are delivered to properties. The lock box is stowed in a storage container with similar aesthetics to a wall mounted mailbox outside of homes or fixed within mail slots in apartment complexes where they can be easily deployed. Inside the storage container a tether is securely fixed to the wall using a variety of fastening methods. The tether is what keeps the lock box secured to the home when deployed. Once the storage container is opened, the collapsible lock box can be pulled out and deployed using its pop-up functionality. The lock box container is of weather resistant, cut resistant, and theft deterrent material. These materials are stretched by a spring steel frame that allows for the box to deploy using its four oval ring structure.

Incorporated into the material is a web of steel security cable that is flexible enough for stowability. This helps deter theft from occurring by creating difficulty to remove or access the pop up lock box's contents. Down the long side of the container, a zipper is present to allow for easy access in and out of the container for package retrieval and placement. At the end of the zipper, a steel fixed ring and combination lock are used to attach the lock box to the home along with ensuring that the lock box is zipped and locked shut. In other embodiments, instead of a combination lock, or in addition to a combination lock other variations may be used including but not limited to, cabled locks, zipper locks from the luggage industry, clip in locks, keyed locks, RFID locks, Smart locks, Bluetooth locks, Sliding bar lock, spring loaded locks, QR Code or barcode locks, etc.

This functionality provides an elegant, lightweight, and user focused product. This invention gives the user their space back when not in use, deters theft, inevitably keeps money in the pockets to those who assume the potential loss, and deliveries are concealed for privacy and protected from the elements.

In combination with the elements and components of the invention (i.e. the pop up container, storage container, and tether), the invention provides a smooth, fast, and usable experience for all users involved for its intended purpose. An example of use cases herein this invention, within the realm of package delivery and handling, are discussed below.

Upon arrival at one's address for package delivery, the delivery driver would first locate the pop up lock box location conveniently affixed by their doorstep or wherever noted by the receiver via shipping companies notes provided by the buyer. The receiver is able to notate directions within shipping companies notes before placing the shipment. The delivery driver would then locate the storage container and open the lid to the storage container, reach in, and pull and remove the pop up container from its storage container with care, noting that due to its pop up functionality it will deploy upon its removal. Once deployed and outside of the storage container, the pop up container will pop open in an "open book" shape. The user will then grab the center inside edge of the container and pull away from the container while holding the opposite side. This movement will allow the container to fully expand into its full opened lock box shape. In other embodiments, this method of deployment may be simplified using attached tethers and handles to assist in the deployment of the pop up lock box. The user will then place the lock box on the ground and drop the package into the inside of the lock box container through the opening on the long end zipper entrance. The user will then grab the bottom handle and tether which is attached to the zipper and pull in opposite directions. This movement will close the zipper allowing it to be in the closed state. The user will ensure that the combination lock attached to the tether is fixed and locked to both the tape end ring and the slider of the zipper ensuring that it is shut and locked closed. The user will then prop up the container to its upright position, and secure the combination lock which is attached to the zipper and the tether. This lock will be attached to the D ring conveniently attached to the lock box securely at the tape end of the zipper. The user will then ensure that the lock is locked by twisting the dials in order to lock the combination lock. The user at this point has completed and demonstrated operating the deployment of this invention.

The reverse process to break down the lock box container is as follows. The receiver approaches the deployed lock box. The receiver accesses and unlocks the combination lock. The receiver pulls the zipper to the bottom tape end to open up the container. The receiver reaches into the opening of the lock box container to retrieve their package and sets it aside. The receiver will start the process of stowing away the invention. The receiver picks up the pop up lock box container and holds the container on opposite sides. The receiver then pushes in any two of the long sides to form an "open book" shape. The receiver tucks the tether into the inside seam of the "book shape." The receiver then closes the "book" shaped container and holds it in two hands in its flat state the long way. With both hands opposite each other holding the product the long way, the receiver twists their hands in a corkscrew motion while pushing inwards to compact the pop up lock box into its folded circular state (NOTE: other variations of this device may inherit the same functionality albeit in a different form. These include but are not limited to deployable draw string locking devices, circular spring devices for deployment, etc.). At this point, the pop up container is under load and can spring back if not properly handled and held securely by the receiver. Because of this, an elastic strap or other form of containment may be used to hold the spring loaded pop up lock box. The receiver firmly holds the folded pop up container, lifts the lid to the storage container mounted onto the secured object, and places the folded pop up container into the storage container until it reaches the bottom of the storage container. The receiver ensures that the tether along with all parts of the pop up lock box is placed into the storage container. At this point the receiver may close the lid to the storage container and may be considered to have completed the reverse action of deployment of this invention. The receiver has actively been able to demonstrate what stowing the device may look like.

Further measures have been taken and implemented in order to increase durability and security. Furthermore, this is a simplistic explanation of the functionality and potential use of this invention. Alternate examples can be found further herein.

Figure 1:
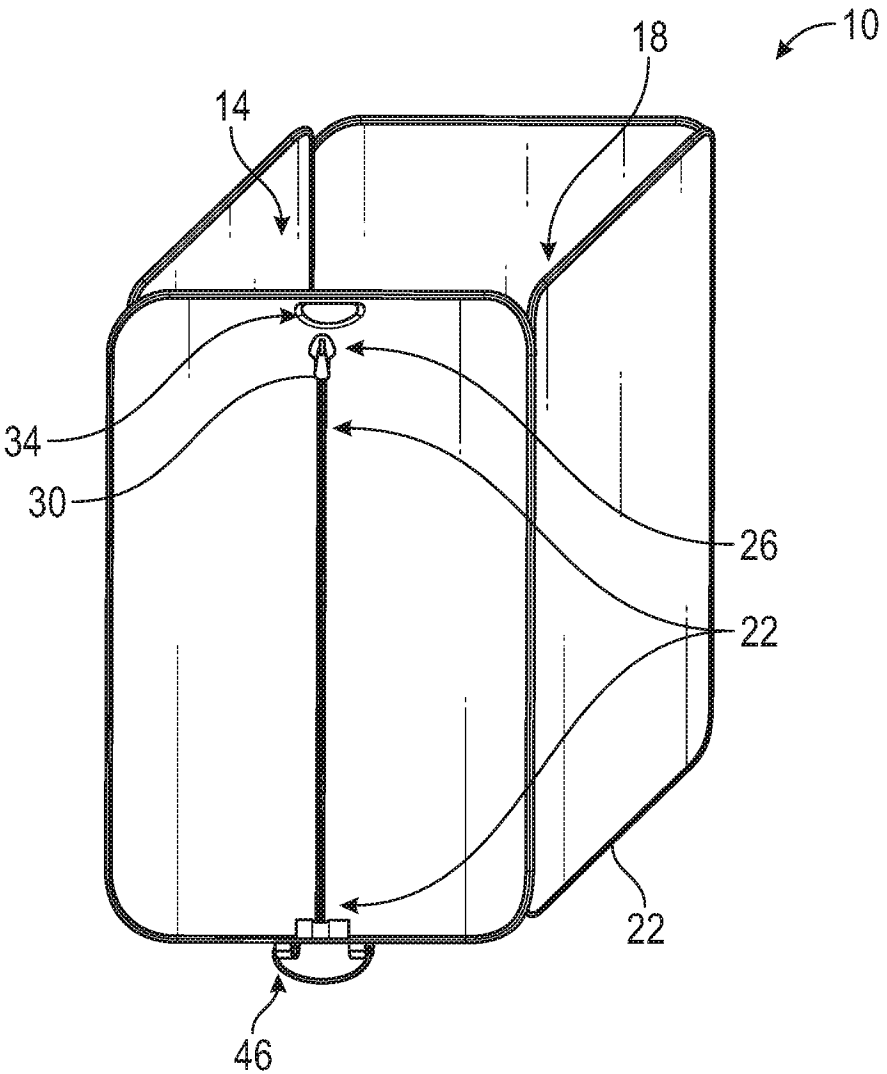
FIG. 1 is perspective view of the collapsible lock box container.
Figure 5:
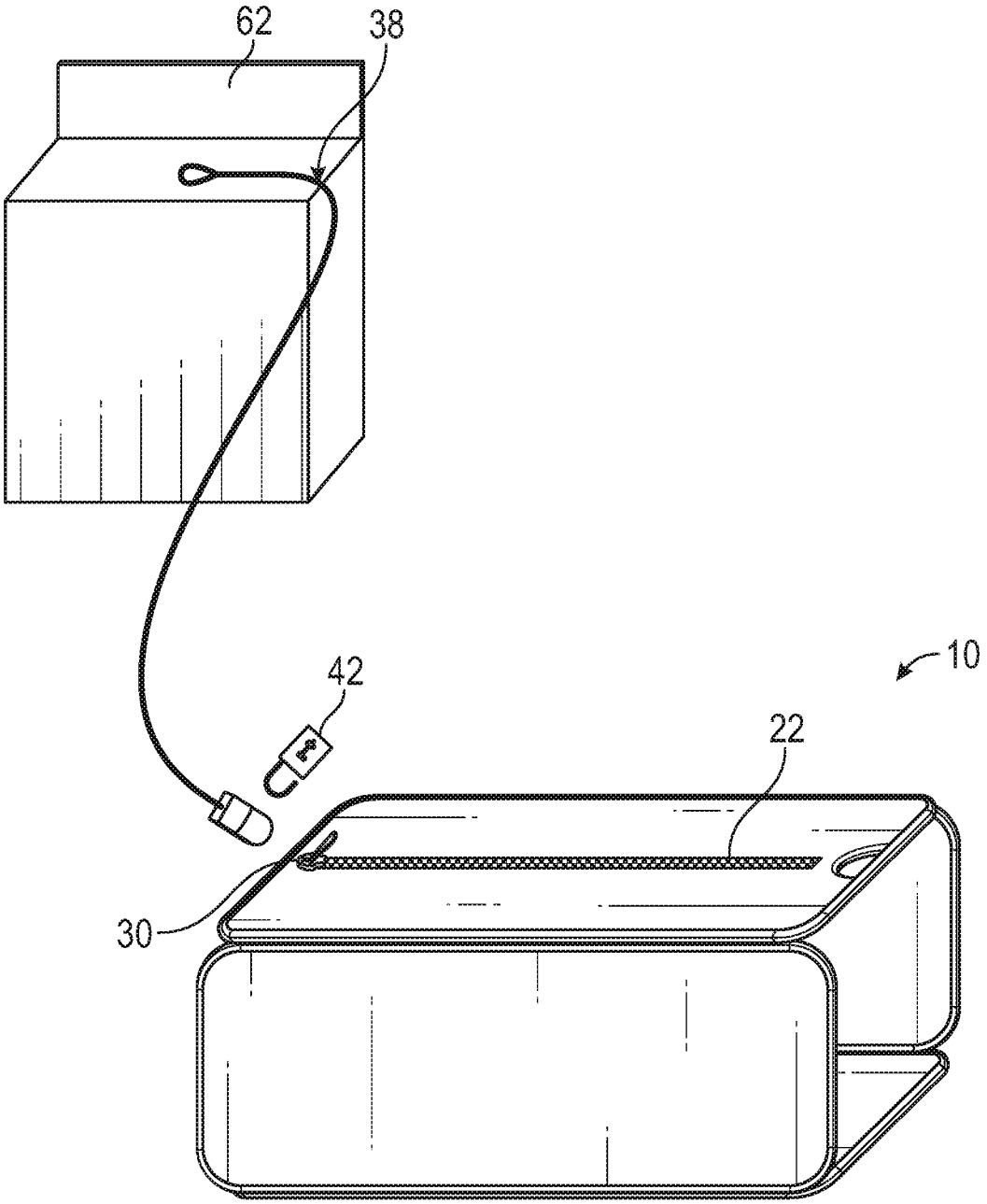
FIG. 5 shows the collapsible lock box container with a storage container and tether.

The present invention comprises of a novel pop up collapsible lock box container 10, one embodiment shown in FIG. 1, with a storage container, see FIG. 5, for the lock box and a tether.

Figure 3:
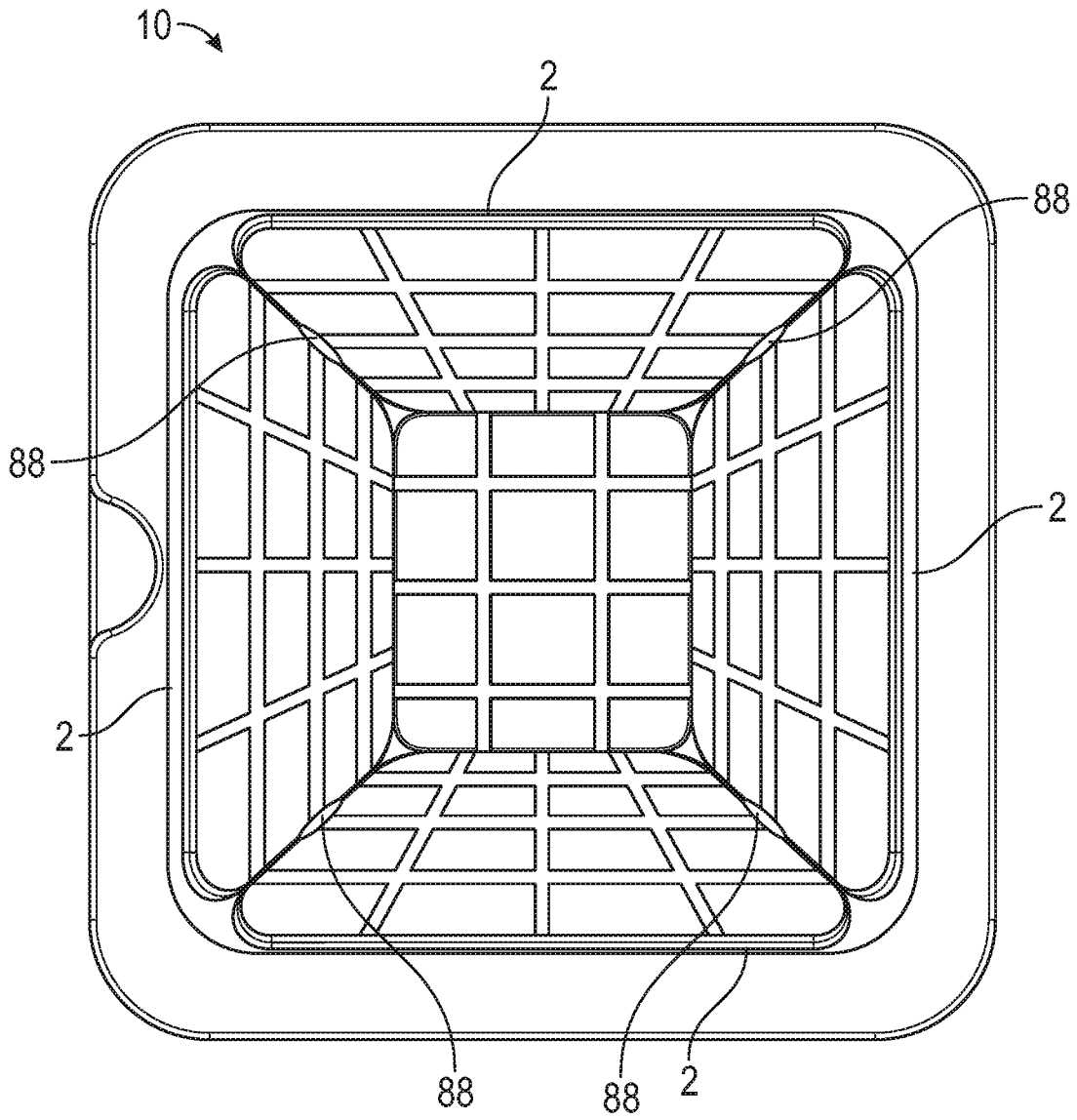
FIG. 3 is a top cross sectional view of the collapsible lock box container.
Figure 4:
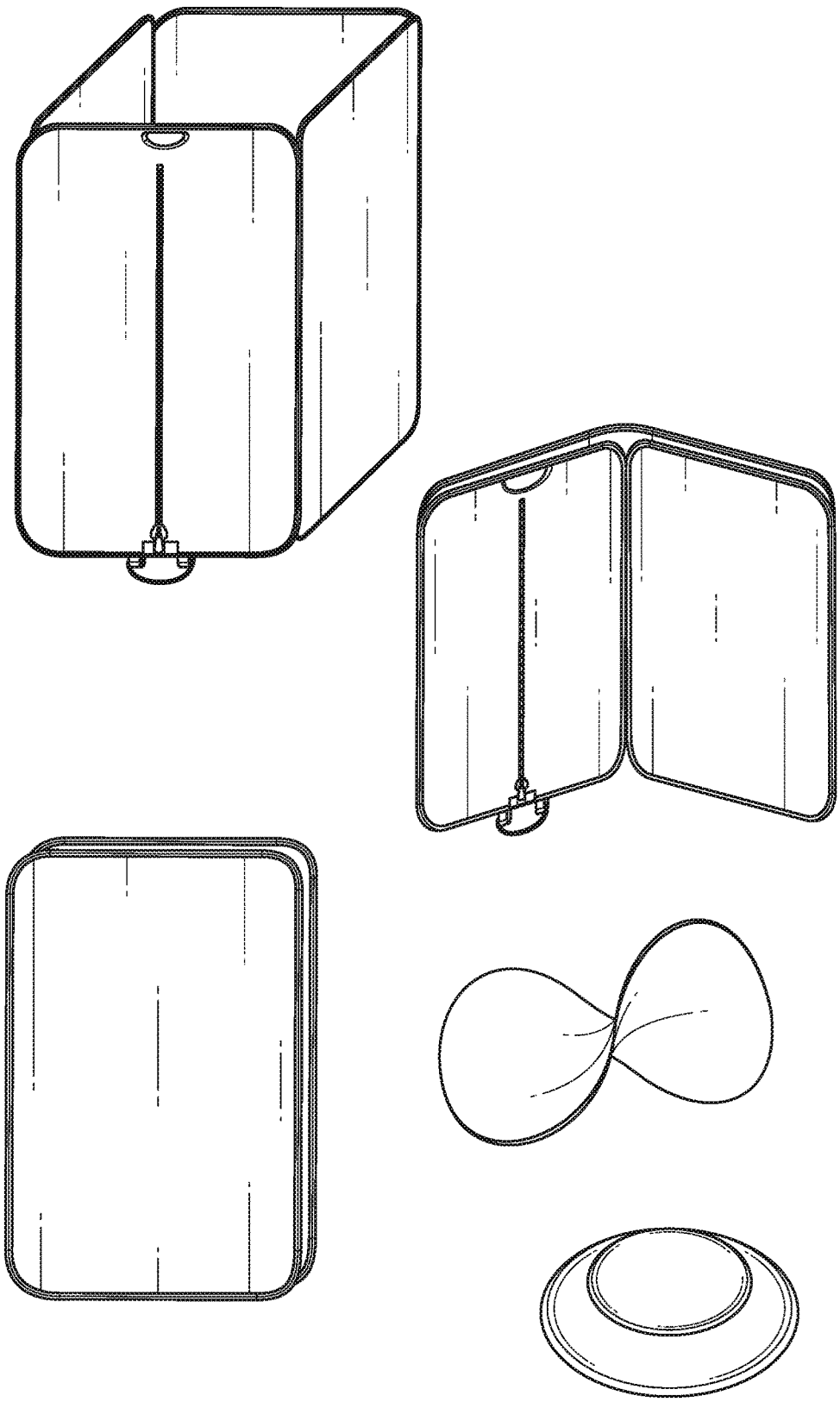
FIG. 4 shows how the collapsible lock box container may be collapsed.

The lock box container may use four spring-steel loops 2 to create the container's edges and works as the skeleton of the container which allows for the container to be collapsible, see FIG. 3. The skeleton frame structure of the device may have other types of structure to allow for the container to be collapsible and stowable. The spring-steel loops are connected using metal crimps 88, see FIG. 3, which may be pressed and glued to connect the ends of the loop together and are shaped using oval sleeves of tear resistant material around the container. The sleeves are attached to the walls of the container and create the shape of the container. The frame may be fixed to the container in a variety of ways in order to allow for the ability of the container to be quickly collapsible, stowable, and deployable.

The container may use a fabric that is composed of a coated polyester material shell, as may be shown in FIG. 1, that is compactible, water resistant, tear resistant, and UV resistant among other needs depending on the users requests and specifications. Stitched into the lock box container may be a steel cable threaded webbing 108, see FIG. 2, which may form a netting/grid pattern that encapsulates the container to prevent tears or cuts from sheers or other sharp objects used to gain access to the container during an attempt at theft. There are alternate ways to accomplish this goal of theft prevention including but not limited to: cut resistant material, cable netting, multi-layered material, the use of alternate patterns (i.e. diamond shaped grids of steel cable, mesh, etc.).

Referring now to FIG. 1, the collapsible lock box container 10 may have a top 14. The top may be made out of a thicker water resistant coated polyester material of which may resemble similar tarp like material. The edges 18 of the top 14 of the container 10 may taper off like a tent to allow proper rain drainage down the seams of the sleeves when the container is in the upright position. In other embodiments herein, a drain port along the edge may be used to flow water off the top of the lock box for proper drainage. The bottom 22 of the container 10 in the upright position also may be of the same kind of material as the top 14 to prevent water seeping in through the bottom which will inevitably further protect the item inside of the collapsible lock box container 10. There are other possible variations that can be employed for the bottom and top of the container in order to prevent damage of the interior items along with preventing easy access.

In one embodiment, on the longest face of the container 10, a mechanical closing system 22 will be used to allow the opening and closing of the container 10 to allow access to the inside of the collapsible lock box container 10. Possible closing mechanisms used to close the container 10 may include, but are not limited to: zippers, latches, snaps, buttons, draw strings, hook and loop fasteners, or any other type of closing device of the container's opening. One example of a closing mechanism that may be used is a zipper system that can be securely stitched into the fabric to leave an opening centered on the long side of the container 10 to allow for both quick straight zip functionality as well as providing the largest length opening to allow for easy access. Other embodiments of the zipper, instead of a straight or linear travel of the zipper, may include but are not limited to a horseshoe/"U" pattern or some other shape to close the container 10. The zippers construction may also include additional layers sewn into the zipper tape of other cut resistant material to protect the edges that run along the zipper. These materials may be sewn on top or on the bottom of the zipper to achieve this functionality. The length of these openings may be just shy of the length of the long side of the container in order to maximize the access opening of the lock box. The length of the zipper will vary depending on the dimensions and size ratio of the container. In the case of the zipper mechanism for closing the container, attached to the slider of the zipper will be a type of handle or usable locking device 26 that is securely attached to the slider 30 for easy handling and locking purposes. When the slider is in the closed state, a secure ring shaped fixture 34 may be used to connect the zipper slider/handle/lock to the ring shaped fixture 34 fixed to the non-sliding portion of the container to successfully fix the container 10 in its locked/closed state.

Attached to the secure ring shaped fixture 34 that is securely attached and stitched to the container 10 with the handle or usable locking device 26 attached, a device used to secure the container 10 is attached, and is shown in FIG. 5. This leash/tether attachment 38, shown on FIG. 5, may be attached elsewhere on the product depending on types of build. A possible use would use a steel galvanized tether 38 attached to an adjustable combination 42 lock that is fixed to the slider 30 of the zipper 22. The adjustable combination lock 42 may have water resistant qualities to ensure product longevity and functionality. The mechanical closing system 22 could be a zipper that will be strong enough to prevent intrusion and easy access to the lock box container 10. The material of the zippers tape and teeth may vary depending on level of security protection desired. The zipper 22 will also provide the users (i.e. delivery drivers) a quick and easy way of pulling the steel tether 38 or the zipper 22 to quickly close and lock the container. Fixed to the bottom tape end of the container 10 may be a sturdy stitched handle 46 to allow users an additional handle 46 to grab and pull the zipper 22 shut. This handle 46 could be directly stitched into the container 10 with a bottom plate to provide additional durability to the material to which it is fixed. When the zipper 22 is in its closed state at the top tape end, the person operating the locking system will be able to connect the combination lock 42 to a secure ring shaped fixture 34 on the container locking the container's zipper 22. The lock 42 will be attached to a coated steel ring (rust prevention) or other anchor point such as the secure ring shaped fixture 34 that is properly affixed to the container 10 at the end of the closed zipper 22. This is stitched into the material using a sturdy material and may also include additional levels of protection to increase deterrence effectiveness. This secure ring shaped fixture 34 may also incorporate an additional level of security by using the skeleton attached to the frame of the container 10.

Figure 6:
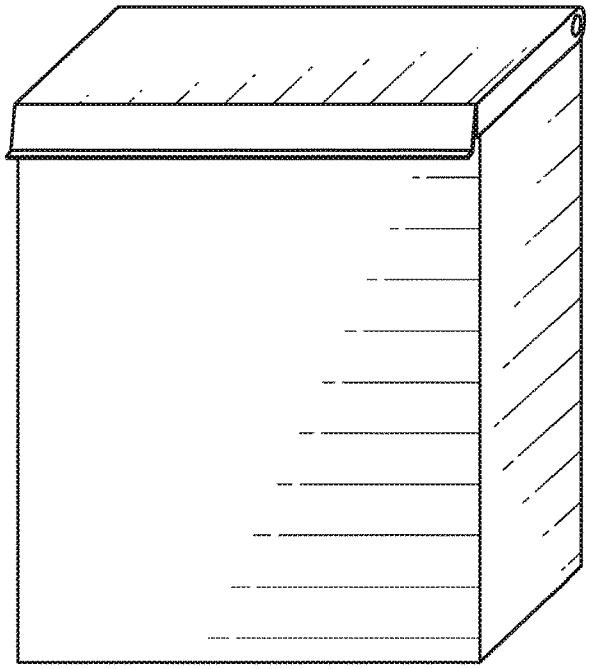
FIG. 6 is a perspective and side view of the storage container.
Figure 6:
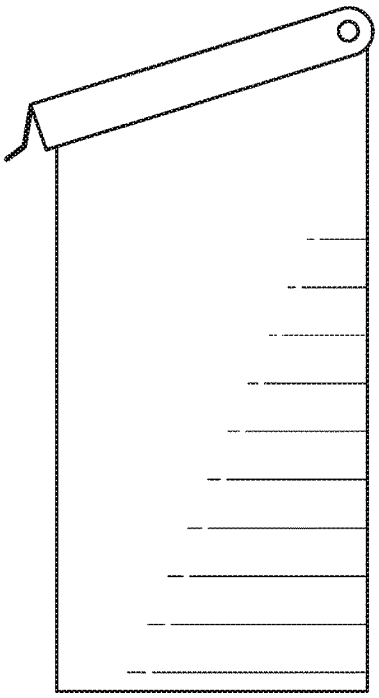
Figure 7:
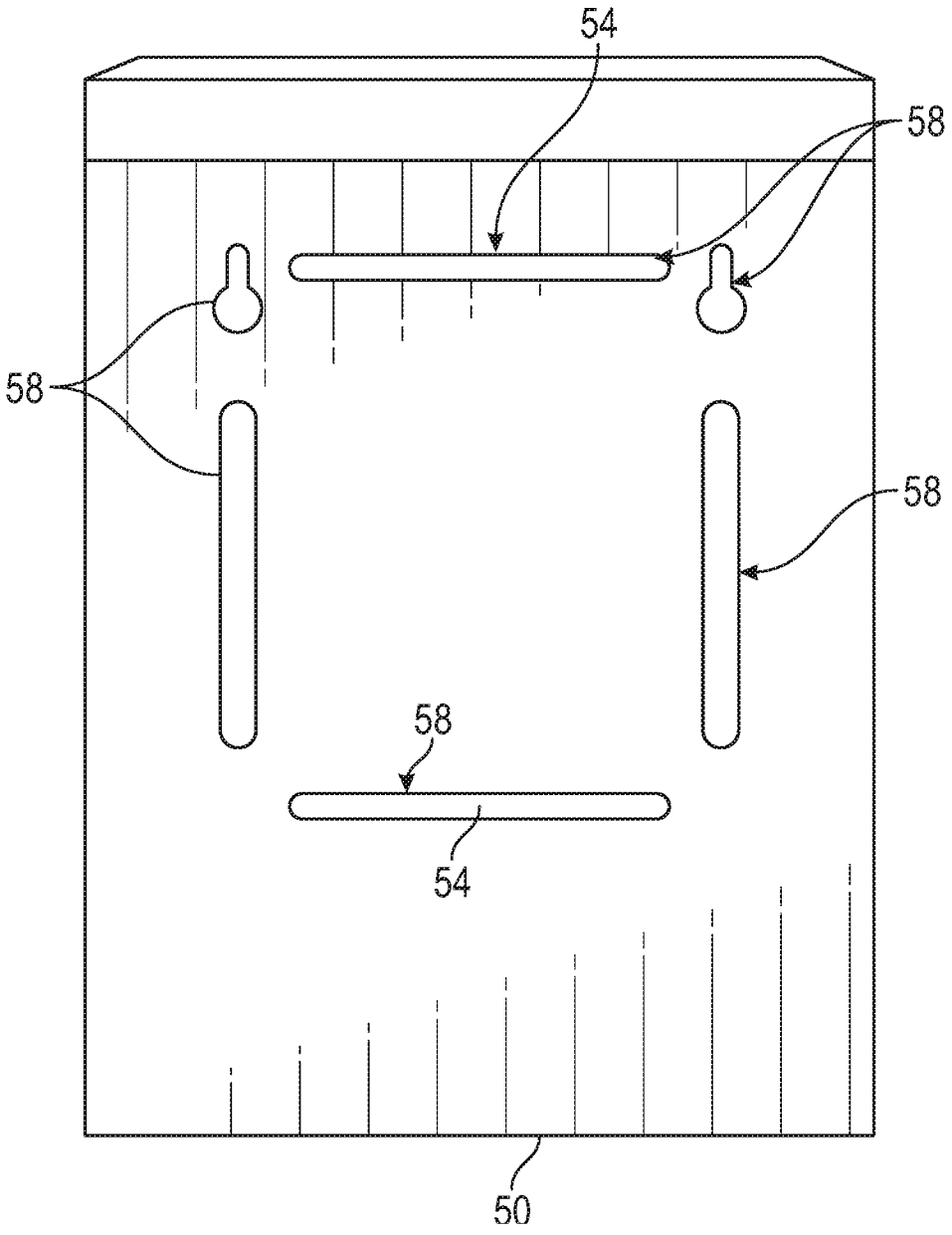
FIG. 7 is a back view of a storage container.

The lock box container 10 on its own may be fixed to a secure object in some form in order to prevent theft, weather related elements or other cause of it being removed from its intended placement. This can be accomplished by fixing the collapsible lockbox container 10 directly to its accompanying storage container 50, see FIG. 6, or other types of secure connection. In this possible example that accomplishes this need, a galvanized steel cable tether 38 of varying gauges can be used to accomplish this. The tether 38 which is attached to the lock box container 10, is securely attached to the secure object directly via screws, looping of the tether or other methods to fix the tether securely to an object using a swaged loop end or other type of securement end of a tether (i.e. screws with washer into studs, security straps to fences, looping tether around railing etc.) The tether 38 may be attached through the inside of the storage container 50 through the back of the container, see the slots 54 in FIG. 7, to further conceal dismantling or removal of the securement method. The tether 38 affixes the collapsible lock box container 10 to the secured object or storage container 50. The storage container 50 may be made of aluminum stamped material (preventative of rust and light weight) which is fixed onto an object or other sturdy object using screws, washers, or other fasteners of this type via the securement holes and/or slots 58 on the back of the storage container. The fasteners will use the slots or holes 58 located on the back of the storage container to fix the storage container in place. Slots on the sides and top provide variations in mounting to ensure proper securement. In addition, various fastening methods can exist to mount wall storage container (i.e. glue, screws, straps, fasteners, brackets). These slots 58 will have the ability to slip securing straps either vertically or horizontally through the back along with screws that can be used for further types fastening depending on the object (user may require storage containers to be affixed to poles, fences and railings, etc.). Three areas of securement will be present, two to secure the storage container 50 to the object where the collapsible lock box 10 will be deployed and one to securely fasten the tether to the object. There may be two sections within the storage container 50. One can be used for mail while the other one will be used for the lock box 10 to be deployed from. This is to cut down on additional wall mounted mailbox/storage containers that are necessary to provide both functions for mail delivery and package delivery. The top lid 62 of the storage container will provide rain protection, see FIGS. 5 and 6. The lid 62 may be hinged at the rear of the product and allow for quick and easy deployment of the lock box container 10 upon lifting the lid 62 in the upwards direction and pulling out the collapsible lock box container 10. The bottom of the storage container 50 may have drainage holes to allow for drainage of any water build up at the bottom of the storage container 50 and allow for proper air flow and ventilation. Other variations of storage containers 50 can be included to provide the same functionality but allow for better valued options, or more elegantly styled pop up lock boxes to provide users with more customization.

The collapsible lock box container 10, storage container 50, and leash/tether attachment 38 provides a solution to the problem of package theft by offering a secure, space-efficient, and user-friendly lockbox system. The invention uniquely combines several innovative features to address the shortcomings of existing solutions.

First, the collapsible lock box container 10 may be constructed on a frame similar to that of a pop up laundry hamper using weather-resistant, cut-resistant materials (ballistic nylon, polyester), protecting packages from both environmental elements and theft. Unlike bulky, expensive traditional lockboxes, this collapsible lock box container 10 is collapsible and can be stowed discreetly in a storage container 50 similar to that of a wall mounted mailbox when not in use. This allows homeowners and renters to save space and preserve the aesthetic appeal of their property.

The collapsible lock box container 10 is easily and quickly deployed by pulling a handle 46 down and away from the mounted storage container 50, which triggers the pop-up mechanism which unfolds and pops open the frame of the collapsible lock box container 10. This may be done by two adjacent cables on one side of the box that once taut provide an anchor point for the handle on the opposing side to fully open the pop up lock box. The tethers and handle pull in opposite directions to fully expand the pop up lock box into its open state. The galvanized steel cables also act to secure the lock box to the property by being attached to the mounted storage container or directly to the property, preventing thieves from easily removing the lockbox and its contents from the property. The puncture-resistant double coiled zipper and combination lock attached to the slider of the lock further safeguard the contents by ensuring that only authorized users can access the package inside.

Within the outside shell of the lock box, a security liner is integrated to enhance the theft-deterrent capabilities of the lock box's fabric. Similar techniques of integration apply in other known products, i.e. Security Device for Luggage. This liner consists of a steel cable mesh or similar cut-resistant material that is embedded into the fabric of the shell. Various patterns can apply including diamond patterns, grid patterns, and spider web patterns for how to integrate the security liner into the shell. The liner provides an additional layer of protection by preventing sharp tools or blades from easily gaining access to the lock box. This liner is stitched directly into the fabric of the shell, ensuring it remains in place and continues to protect the box's contents from unauthorized access. The security liner extends to key vulnerable areas, such as the zipper and entry points, providing extra reinforcement where thieves may attempt to gain access. The integration of this liner within the shell ensures that the lock box remains lightweight, collapsible, and easy to store, while still offering a high level of security.

In contrast to surveillance cameras or hiding instructions, which do not physically secure deliveries, this invention directly prevents theft by denying access to the package itself and provides additional privacy. Additionally, the weather-resistant materials ensure that packages remain safe from environmental hazards, meeting both the security and protective needs of package delivery.

The invention also offers a cost effective, scalable solution that can be adopted by individual homeowners, renters, and commercial properties alike. Its collapsible design and lightweight materials reduce production and shipping costs, making it accessible to a wider audience without sacrificing security or functionality. The combination of theft deterrence, weather protection, space efficiency, and ease of use makes this invention a practical and innovative solution to the problem of unattended package deliveries.

The Collapsible Pop-Up Lock Box with Mountable Storage Container & Tether is distinct from existing products and methods in several critical ways, providing a more comprehensive, efficient, and practical solution for last-mile delivery.

Collapsibility and Space Efficiency: One of the key differentiators of this invention is its collapsible design, which allows the lock box to fold flat and be stored within a compact, wall-mounted storage container when not in use. Existing solutions, such as traditional lockboxes or storage bins, are typically large, bulky, and permanently placed, taking up valuable porch or entryway space. These fixed structures can detract from the aesthetic appeal of a property and are impractical for users with limited space. In contrast, the collapsible nature of this invention provides the security of a large lock box only when needed, without the burden of constant space occupation.

Lightweight and Cost Efficient Materials: The lightweight materials used in this invention, such as weather-resistant fabrics and flexible spring back steel frames, significantly reduce manufacturing costs without sacrificing security or durability. This makes the product more cost efficient and accessible while still offering robust protection against theft and environmental factors.

Integrated Theft Deterrent Features: The security tether system integrated into this invention is a key differentiator offering both a functional component along with a security benefit. This tether may be made of galvanized steel, stainless steel cables, and or other like material with these durable properties that anchor the lock box securely to the property, preventing the box from being easily removed or stolen. Additionally, the cut-resistant shell, reinforced with steel wire security liner, provides another layer of security against slashing or puncturing attempts. The combination of the tether system and the puncture-resistant locking zipper in this invention ensures that the box and its contents are secure, even when exposed to the elements or attempts of forced entry.

Weather-Resistant and Durable Construction: This invention differentiates itself by using high-quality, weather-resistant materials, such as coated polyester or nylon, which are flexible yet durable. The fabric is treated to be water-repellent, UV-resistant, and tear-resistant, ensuring long-term use in outdoor conditions. The added features, such as a rain flap over the zipper or waterproofing of the zipper, a tapered design to drain water away from the top make it far more effective at protecting packages from rain, snow, and other weather-related damage.

Ease of Use and Deployment: This invention offers a simplified, single-motion deployment. The lock box is stored in a wall-mounted container and can be deployed by simply pulling on a handle, which triggers the pop-up mechanism. The use of spring steel frames ensures that the box quickly opens into its full shape without complicated steps. This ease of deployment is particularly advantageous for delivery drivers who need to quickly secure packages and move on to their next delivery.

Aesthetic and Space-Saving Design: The discreet, mountable storage container used in this invention allows the lock box to remain hidden from view when not in use, preserving the aesthetic appeal of the property. The container can be mounted to a variety of surfaces, such as walls or railings, making it versatile for different property types, including houses, apartments, or commercial locations. This sleek design ensures that users do not have to compromise between security and maintaining the appearance of their home or business.

Modular and Adaptable Use Cases: This invention offers adaptability across different use cases. The lock box can be used with or without the wall-mounted container and can be tethered to various objects, making it useful in a range of settings beyond just home deliveries. The modular design means it can be deployed in urban, suburban, or even rural environments, adjusting to the specific needs of the user. Additional use cases may include: Lightweight portable securement containers, portable locking safe for contractors on job sites for tools, outdoor events/festival staff needing portable locking safe for tickets/merchandise, camping, military uses and so on.

The design also allows for easy upgrades or customizations, such as different sizes or configurations, which current products do not offer.

Materials

Outer Shell: The shell may be made from coated polyester or nylon fabric. This material is treated to be water-resistant, UV-resistant, and tear-resistant. A flexible cut-resistant security liner, such as steel wire mesh, stainless steel cables, or Kevlar, may be integrated within the shell to provide extra protection against theft.

Frame: The frame may consist of four spring steel loops that run along the edges of the lock box. These loops are inserted into sleeves stitched into the shell material, allowing the lock box to "pop up" upon deployment. The frame materials can vary, but spring steel is preferred for its durability and memory retention.

Tether: The tether may be made from galvanized steel cable or stainless steel, which is corrosion-resistant and strong enough to prevent the lock box from being moved or stolen. The tether connects the lock box to a fixed point on the property, usually attached through mounting points in the storage container. The tether may run in parallel from each other from the mounting points in the storage container and then travel outwards away from each other and are connected via secure anchor points on the lock box. This allows for the lock box to be deployed in the correct position with the zipper facing upwards.

Storage Container: The storage container may be made from lightweight metal, such as aluminum, which is stamped or extruded to form a rectangular box. The container has an opening at the bottom to allow the lock box to deploy when needed. The opening inside edge on one of the long sides may have a slight inward bend to provide a surface that will prevent the spring loaded pop up lock box from slipping out. It is designed to be wall-mounted using screws, washers, or straps, depending on the surface. Alternate fastening methods may exist like cut resistant straps for poles or railings. The back side of the storage container will have slots that may be used to secure securement straps directly to the back of the container for mounting on various permanent objects.

Construction

Frame Assembly: The spring steel loops may be cut to the proper dimensions and are then inserted into the reinforced fabric sleeves that run along the edges of the shell. The ends of the spring steel are crimped securely to maintain their circular form.

Shell Fabrication: The outer shell may be cut to size and stitched together with reinforced seams. The cut-resistant liner is stitched into the interior of the shell, running throughout the entire structure to prevent slashing. The seams may be sealed with waterproof stitching or seam tape to prevent water ingress. A rain flap is additionally stitched running alongside the track of the zipper to help prevent rain water from seeping in.

Figure 8:
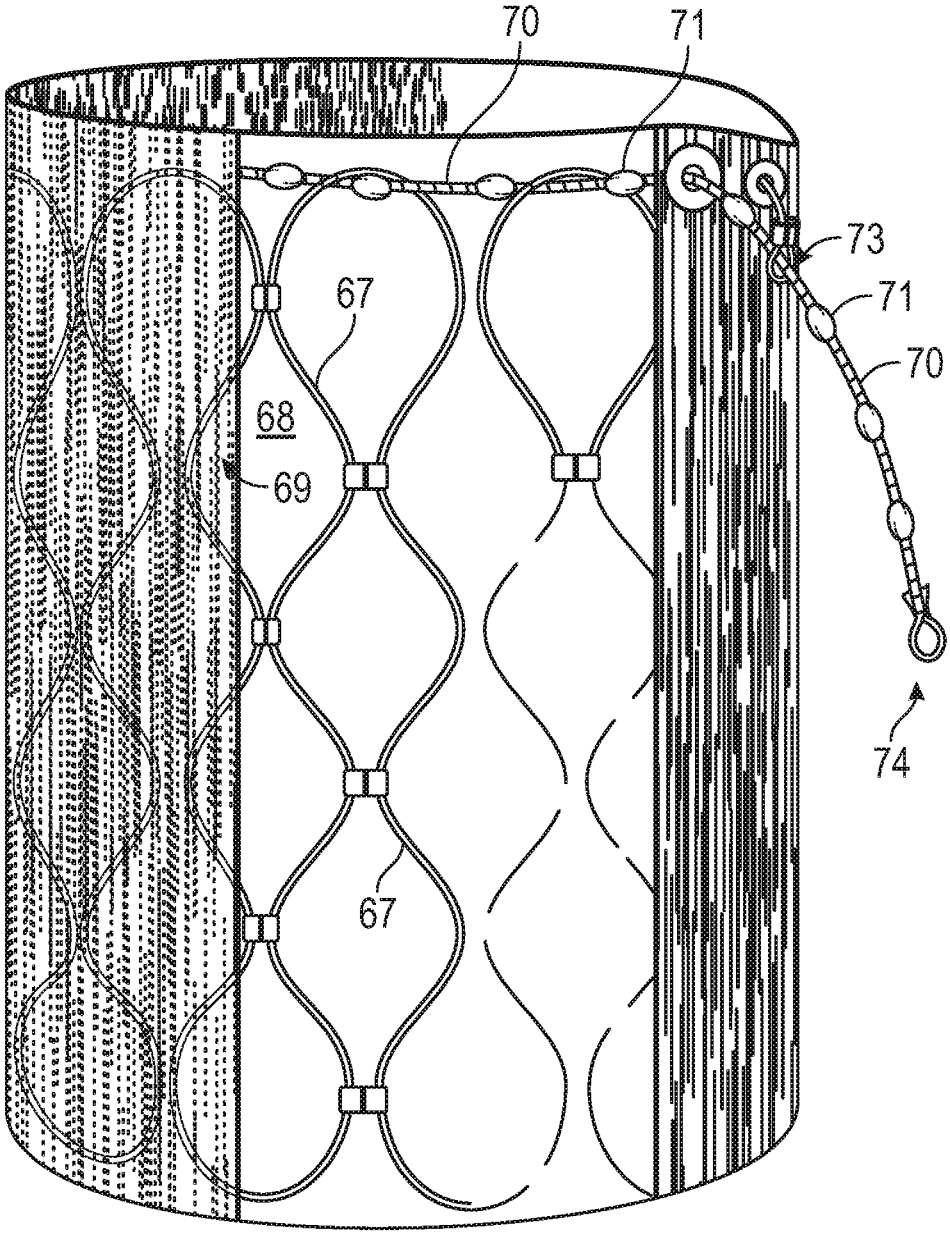
FIG. 8 shows a perspective view of a security liner.
Figure 11:
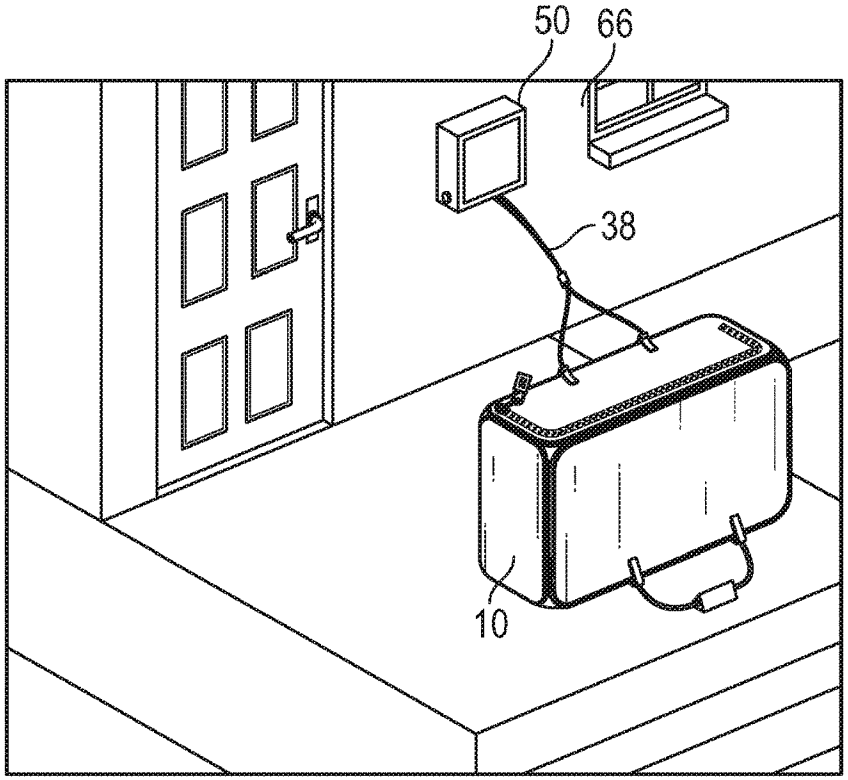
FIG. 11 shows the collapsible lock box container deployed from the storage container and attached to the tether.

The collapsible lock box container 10 may use a security liner as disclosed with respect to FIG. 11 from U.S. Pat. No. 6,244,081. FIG. 8 is a reproduction of FIG. 11 from U.S. Pat. No. 6,244,081.

Tether Integration: The tether 38 may be affixed to anchor points along the shell of the lock box container 10, typically at the edge of the lock box. spaced centered down the long side about 8 inches apart. The anchor points may be constructed with cut resistant and reinforced stitching directly into the shell to ensure durability. The anchor point may take on various forms such as loops. grommets in fabric, looped cable, etc. The tether 38 may comprise steel cables that are attached using crimped loops and reinforced stitching to ensure they remain securely in place during both deployment and storage.

Handle application: The handle 46 may be double stitched with patterns that exist to ensure durability a flexible handle will be attached on the opposing side to the anchor points. The handle 46 may hang just below the opening of the storage container for easy access. Additional handles may be implemented for various use cases.

Zipper and Locking Mechanism: A puncture-resistant double-coiled zipper 22 may be sewn into the top U-shaped opening of the lock box. At the end of the zipper 22, the handle or usable locking device 26 may be a ring-shaped anchor point is attached, which allows the zipper slider to be secured with a combination lock, preventing unauthorized access. Additional locking methods may be used to achieve the same functionality as the combination lock.

Storage Container Construction: The storage container 50 may be formed through stamping or extrusion of aluminum material. It is shaped into a rectangular box with an open bottom for easy deployment of the lock box. Inside the container on the bottom, a bent tab or similar retention mechanism prevents the lock box from sliding out until pulled by the user. Mounting holes or brackets are included on the back for securing the container to a wall or other fixed structure.

How to Use the Invention

The collapsible lock box container 10 is designed to be simple to deploy, secure, and stow. The following steps describe the preferred method for using the invention.

Installation

Mount the Storage Container 50: The user mounts the storage container to a fixed surface, such as a wall, railing, or post, near the front door or package drop-off location. The container is fastened using screws, washers, or straps that fit through the mounting slots on the back of the container. Various other methods of mounting exist including using a separate mounting bracket 72 to attach the storage container to the surface.

Attach the Tether: The security tether 38 is attached inside the storage container 50 and anchored to the fixed structure (e.g., the wall or a sturdy fence). This prevents the lock box from being stolen when deployed.

Package Delivery: When a delivery is made, the driver pulls the looped handle down and away positioned at the bottom of the storage container. This handle is attached to the lock box inside.

Automatic Deployment: As the handle is pulled downward, the collapsible lock box container 10 unfolds from the storage container due to the tension in the spring steel frame. The tethers attached to the box stabilize it, preventing it from flipping over. Additionally, once the tethers are taut the inside edge of the lock box will be pulled outwards by the attached security tethers ultimately fully deploying the collapsible lock box container 10.

Placing the Package: The driver places the package inside the collapsible lock box container 10 through the zipper opening and zips it closed. The zipper slider is then secured using the built-in combination lock to prevent unauthorized access.

Final Position: Once deployed, the collapsible lock box container 10 sits on the ground, tethered to the property and secured from theft.

Retrieving the Package

Unlock the Box: The package recipient approaches the deployed collapsible lock box container 10 and unlocks the combination lock securing the zipper. They unzip the collapsible lock box container 10 and retrieve the package.

Stowing the Lock Box: After the package is removed, the recipient folds the collapsible lock box container 10 by pressing the sides inward and twisting the spring steel frame into its collapsed form. The tether is tucked into the collapsible lock box container 10, and the entire unit is stored back into the storage container with the handle hanging out of the bottom of the storage container, ready for the next use.

Embodiments

One embodiment of the invention is the collapsible lock box container 10 and storage container 50 as described. This provides optimal balance between security, ease of use, and affordability. The galvanized steel security tether, puncture-resistant zipper, security liner, and functionality of the spring steel loops are critical components of this embodiment, as they provide superior theft deterrence while maintaining the lightweight, collapsible nature of the product.

Alternative embodiments may include variations in the materials or size of the lock box and storage container. For instance:

The outer shell can be made from different weather-resistant materials, depending on the specific environment in which the lock box will be used.

The storage container 50 can be designed with additional compartments for mail or other small deliveries.

The storage container 50 can be designed with the intention of integrating other smart home devices (i.e. Ring cameras, security systems, doorbell cameras).

Figure 9:
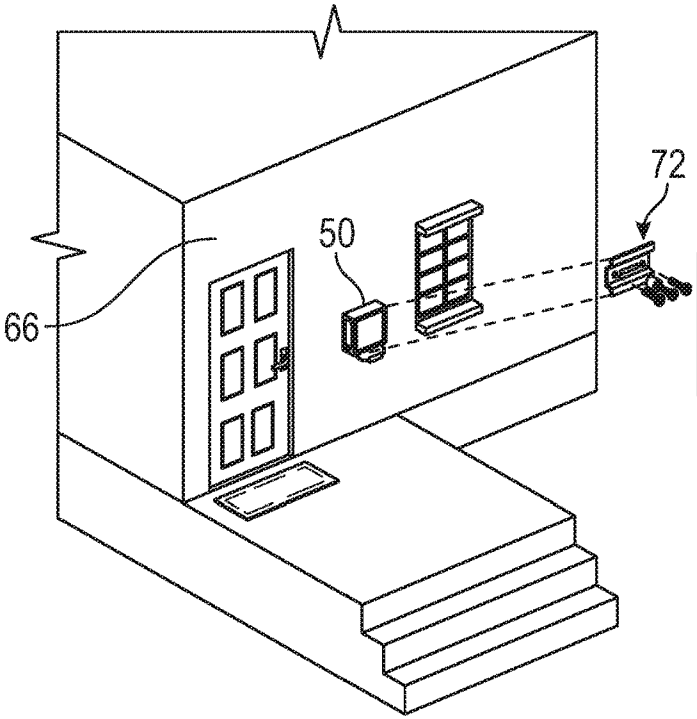
FIG. 9 shows a house with a storage container permanently attached to the house.

FIG. 9 shows a house 66 with the storage container 50 permanently attached to the house 66.

Figure 10:
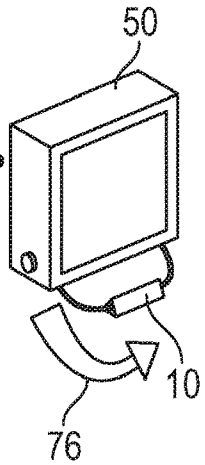
FIG. 10 shows an exploded view of the storage container.

FIG. 10 shows an exploded view of the storage container 50 with the fasteners 72 used to attach the container 50 to a permanent structure, such as a house 66. Additionally, the arrow 76 shows how the collapsible lock box container 10 may be deployed from the storage container 50.

FIG. 11 shows the collapsible lock box container 10 deployed from the storage container 50, and attached to the tether 38.

Figure 12A:
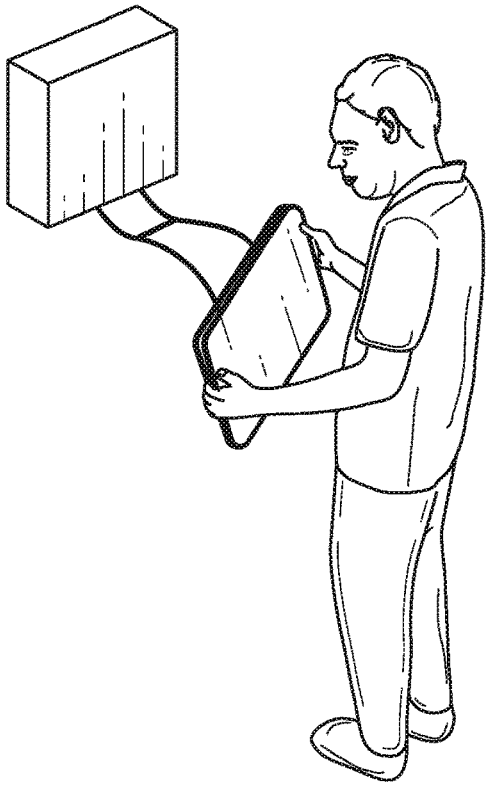
FIGS. 12A-12D shows the steps of folding the collapsible lock box container.
Figure 12B:
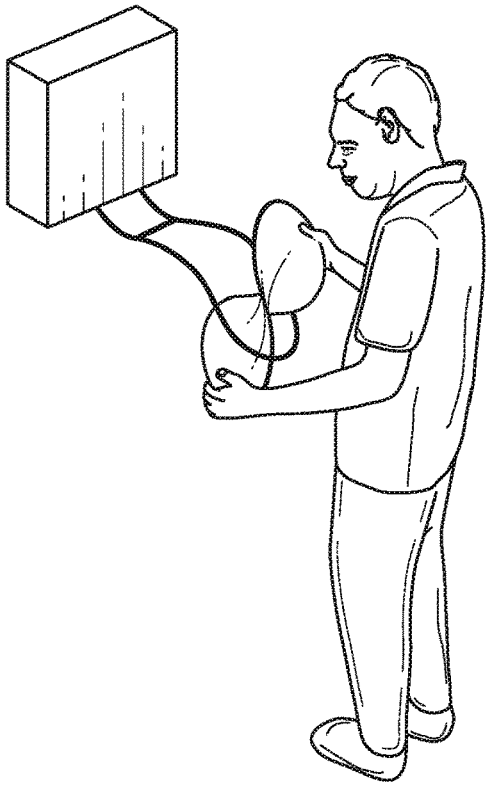
Figure 12C:
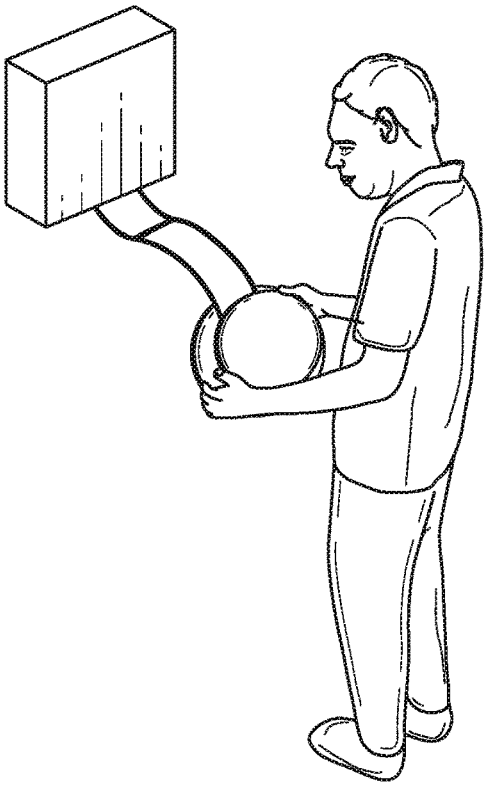
Figure 12D:
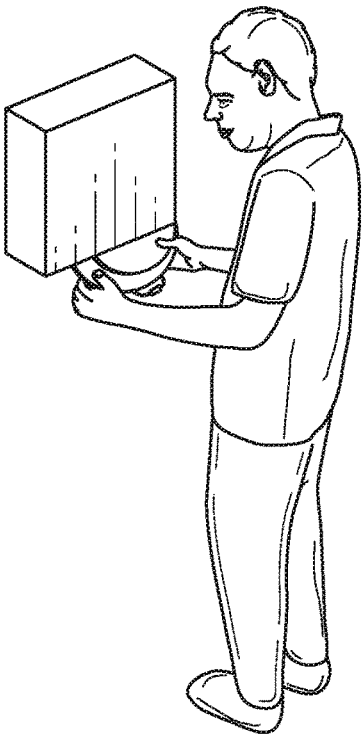

FIGS. 12A-12D shows the steps of folding the collapsible lock box container 10. FIG. 12A shows the collapsible lock box container 10 in a deployed state. FIG. 12Bb shows a user twisting the collapsible lock box container 10. FIG. 12C shows the user folding the collapsible lock box container 10, and FIG. 12D shows the collapsible lock box container 10 in a folded up state ready to be stored in the storage container 50.

Figure 13A:
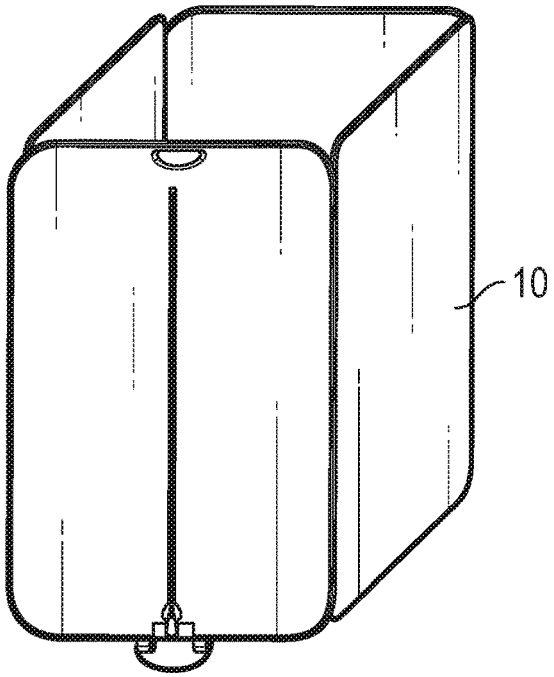
FIGS. 13A-13E shows the steps of folding the collapsible lock box container.
Figure 13B:
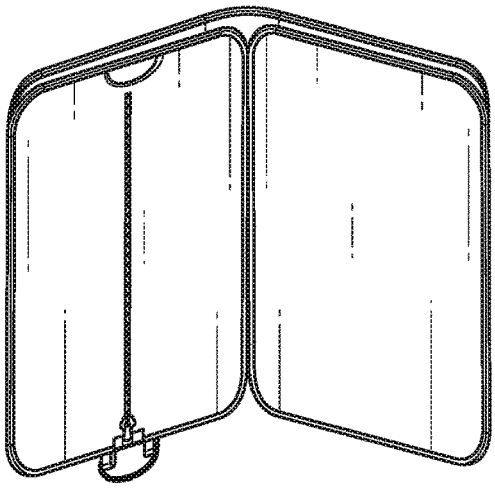
Figure 13C:
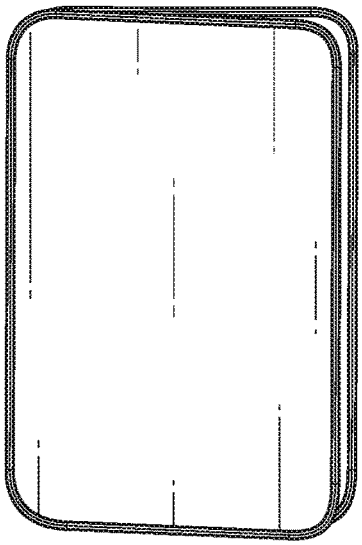
Figure 13D:
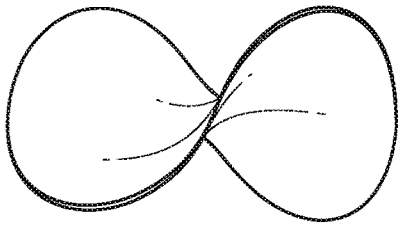
Figure 13E:
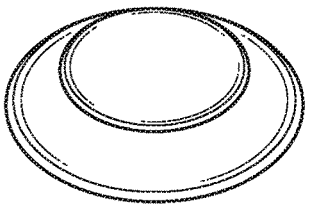

Similarly, FIGS. 13A-13E shows the steps of folding the collapsible lock box container 10. FIG. 13A shows the collapsible lock box container 10 in a deployed state. FIG. 13B shows the collapsible lock box container 10 collapsed from a cuboid shape to a parallelepiped shape. FIG. 13C shows collapsible lock box container 10 folded generally in half. FIG. 13C shows the collapsible lock box container 10 twisted into a generally FIG. 8 shape. FIG. 13E shows the FIG. 8 shape from FIG. 13D folded in half, and ready to be stored in the storage container 50.

Figure 14:
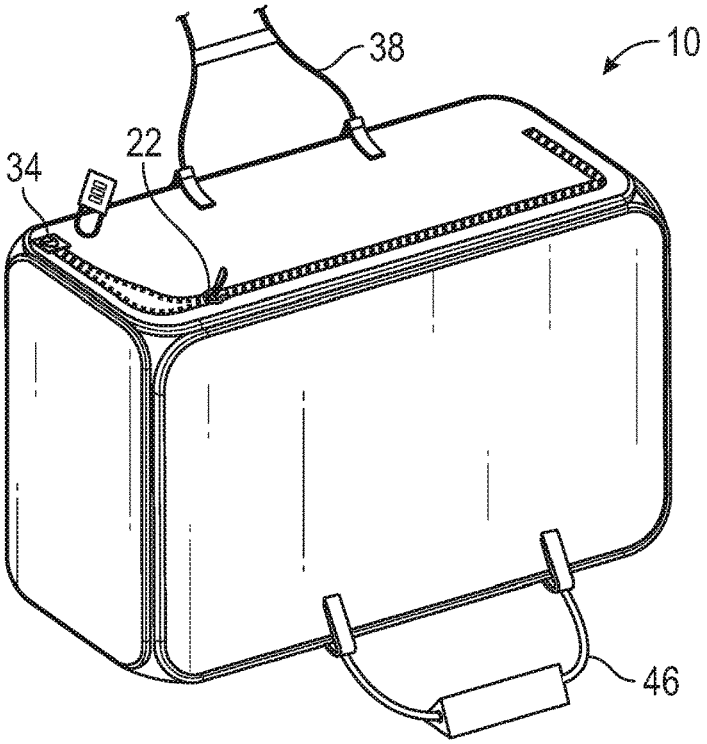
FIG. 14 shows the collapsible lock box container in the process of being closed.

FIG. 14 shows the collapsible lock box container 10 in the process of being closed.

Figure 15:
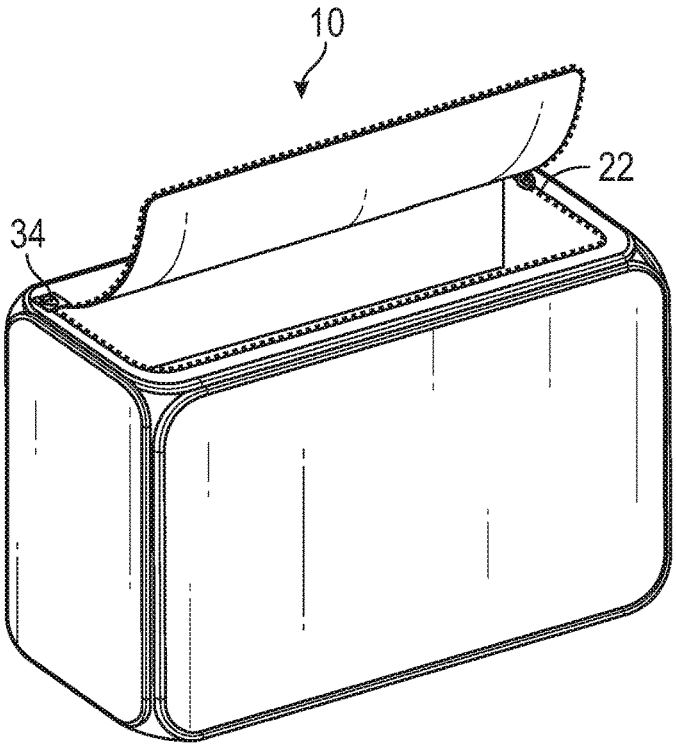
FIG. 15 shows the collapsible lock box container 10 in opened configuration.

FIG. 15 shows the collapsible lock box container 10 in opened configuration.

Figure 16A:
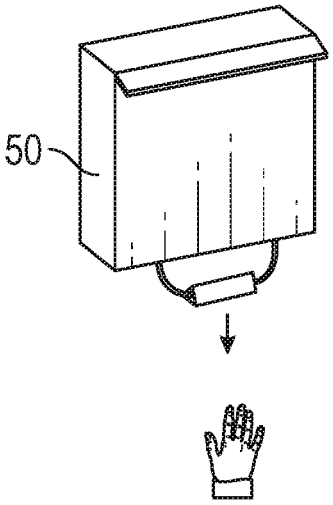
FIG. 16A-16F shows how the collapsible lock box container may be deployed from a storage container.
Figure 16B:
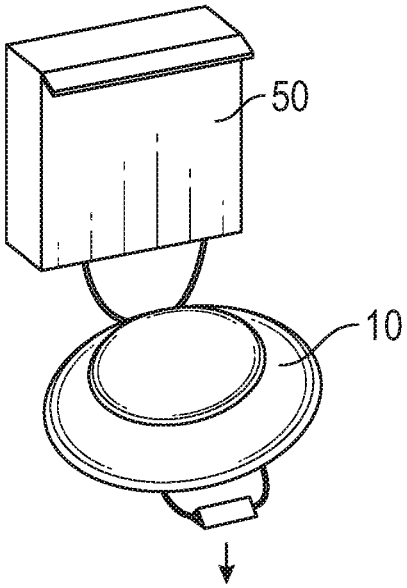
Figure 16C:
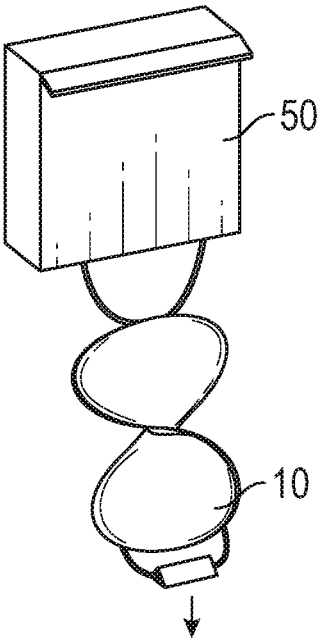
Figure 16D:
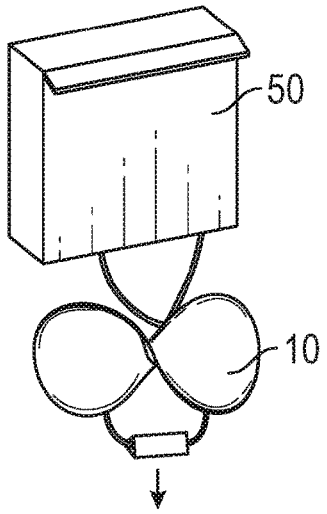
Figure 16E:
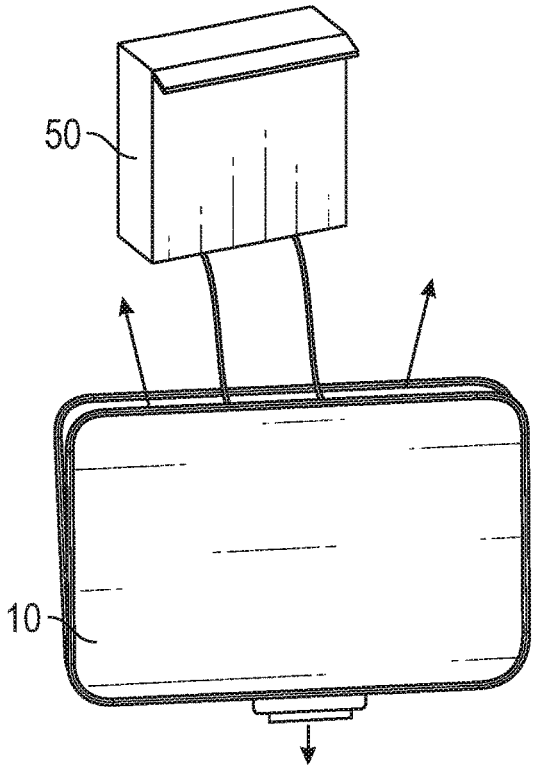
Figure 16F:
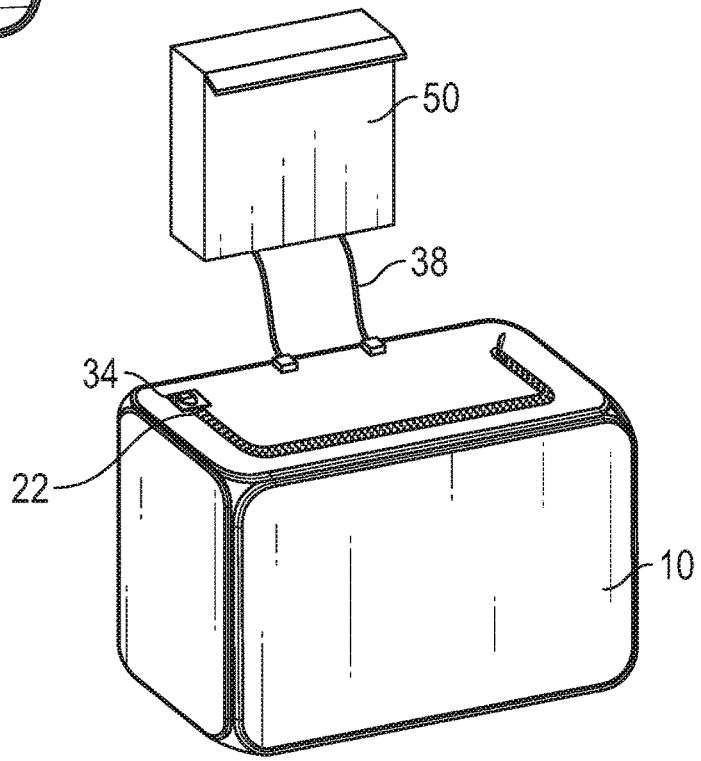
Figure 17A:
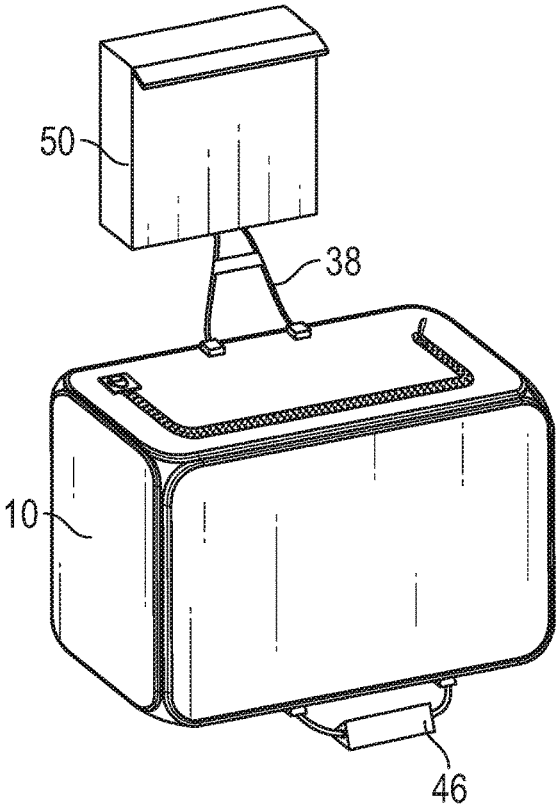
FIGS. 17A-17F shows how the collapsible lock box container may be folded and stored back in the storage container.
Figure 17B:
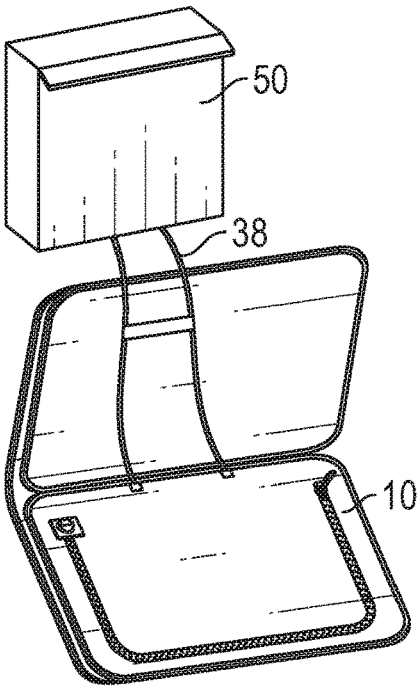
Figure 17C:
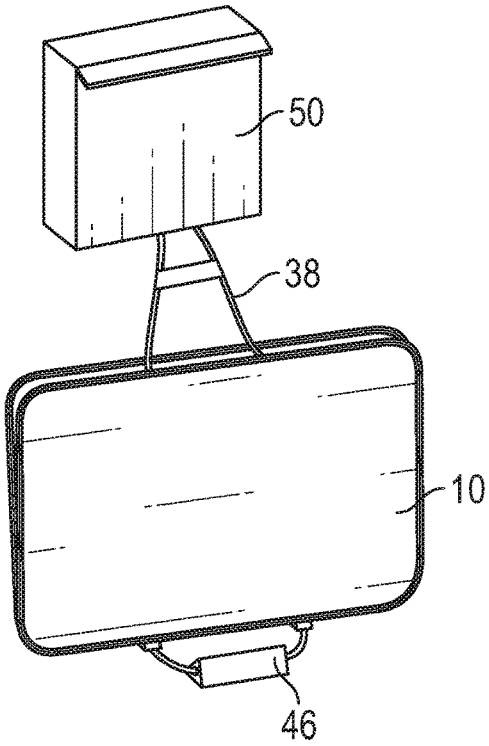
Figure 17D:
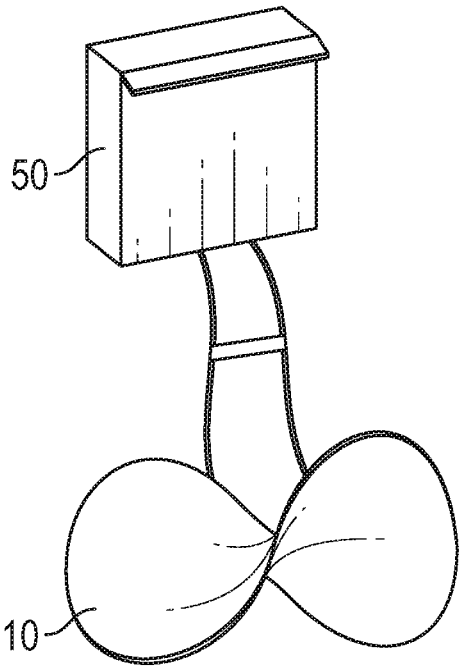
Figure 17E:
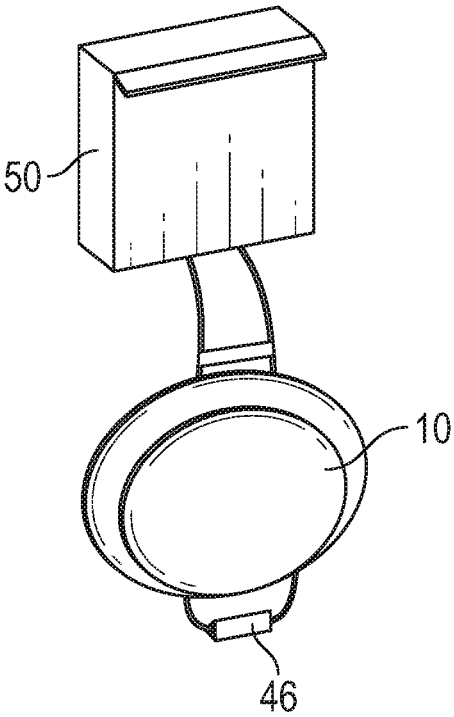
Figure 17F:
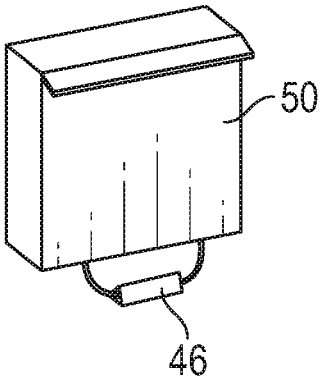

FIG. 16A-16F shows how the collapsible lock box container 10 may be deployed from a storage container 50. As the collapsible lock box container 10 is pulled out of the storage container 50, it automatically will unfold and deploy into its cuboid shape as shown in FIG. 16F.

FIGS. 17A-17F shows how the collapsible lock box container 10 may be folded and stored back in the storage container 50.

Figure 18:
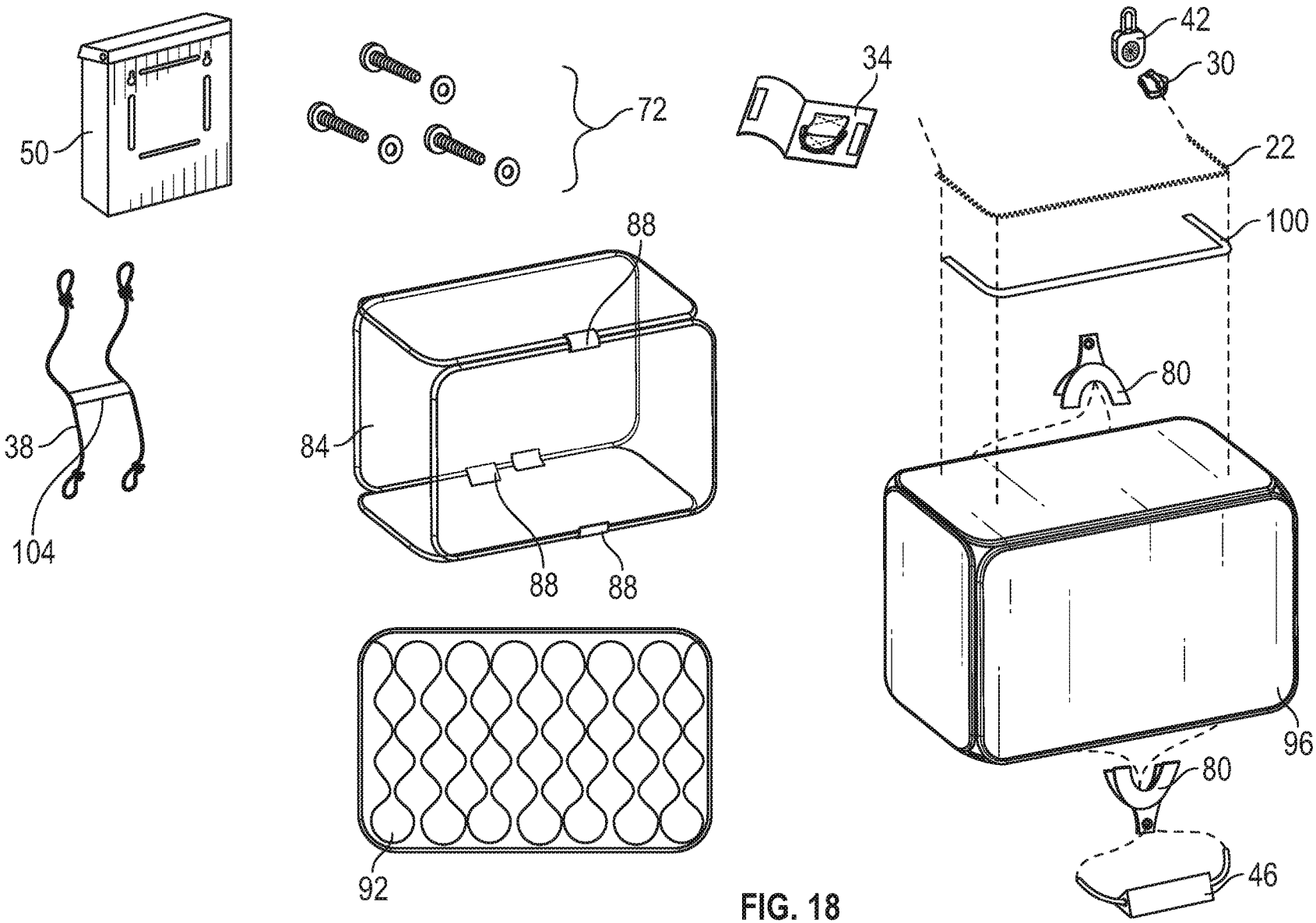
FIG. 18 shows the various components and accessories for the collapsible lock box container and storage container.

FIG. 18 shows the various components and accessories for the collapsible lock box container 10 and storage container 50. The anchors 80 are used to provide more support and strength to the collapsible lock box container 10 for attaching the secure ring shaped fixture 34 and sturdy stitched handle 46. The frame 84 of the collapsible lock box container 10 may comprise steel loops. The frame 84 may have crimps 88 to maintain the form and collapsibility of the collapsible lock box container 10. The collapsible lock box container 10 may have a security liner 92. The collapsible lock box container 10 may also have a weather resistant durable outer shell 96. The collapsible lock box container 10 may also have a rain flap 100. The tether 38 may have a tether stabilizer 104.

Figure 19:
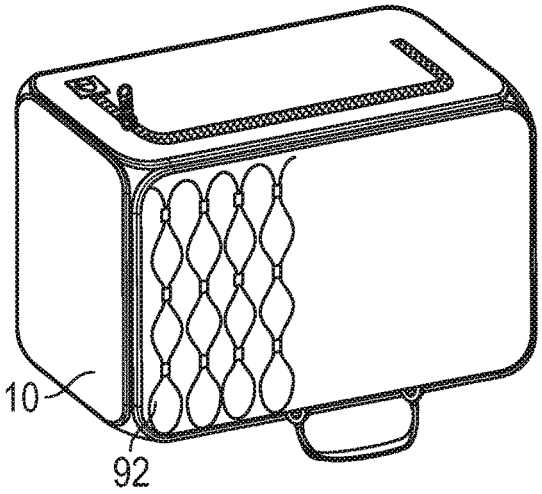
FIG. 19 shows a security liner being stitched into a collapsible lock box container.

FIG. 19 shows how the security liner 92 may be stitched into the fabric of the collapsible lock box container 10, or may be applied to the outer or inner surface of the collapsible lock box container 10. The security liner 92 will prevent the cutting, tearing, or accessing of the collapsible lock box container 10 by thieves, porch pirates, or other bad actors. The security liner 92 may be made out of difficult to cut material, such as but not limited to plastic, metal, fiberglass, cable mesh, steel loops, etc.

Figure 20:
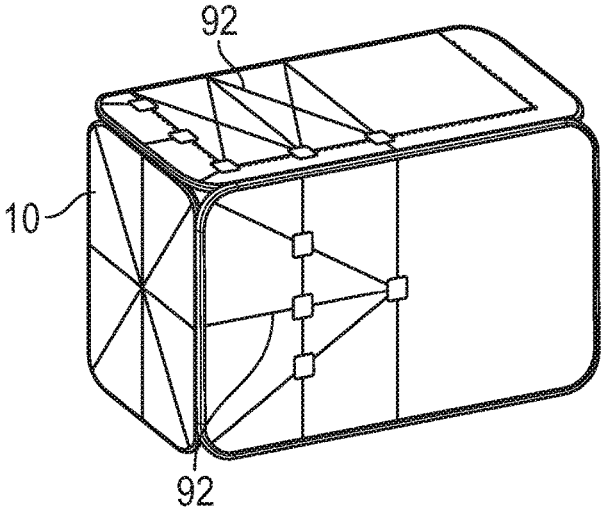
FIG. 20 shows another embodiment of a security liner that may stitched into the fabric of the collapsible lock box container.

FIG. 20 shows another embodiment of a security liner 92 that may be stitched into the fabric of the collapsible lock box container 10, or may be applied to the outer or inner surface of the collapsible lock box container 10. This shows how the security may have a different design than the repeating diamond shape shown in FIG. 19.

Figure 21:
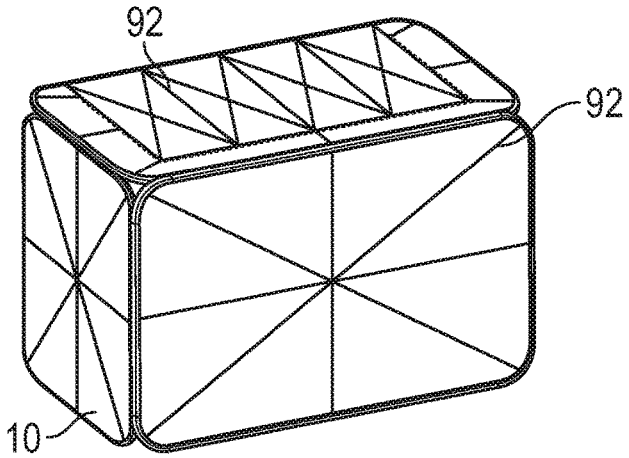
FIG. 21 shows yet another embodiment of a security liner that may stitched into the fabric of the collapsible lock box container.

FIG. 21 shows yet another embodiment of a security liner 92 that may stitched into the fabric of the collapsible lock box container 10, or may be applied to the outer or inner surface of the collapsible lock box container 10. This shows how the security may have a different design than the repeating diamond shape shown in FIG. 19.

Figure 22:
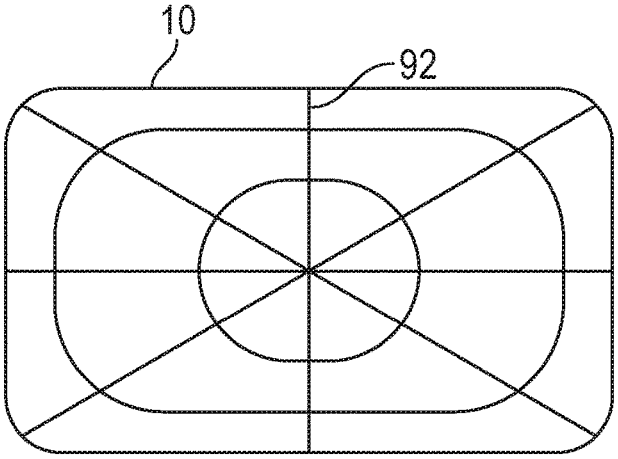
FIG. 22 shows another embodiment of a security liner that may stitched into the fabric of the collapsible lock box container.

FIG. 22 shows another embodiment of a security liner 92 that may stitched into the fabric of the collapsible lock box container 10, or may be applied to the outer or inner surface of the collapsible lock box container 10. This shows how the security may have a different design than the repeating diamond shape shown in FIG. 19.

Figure 23:
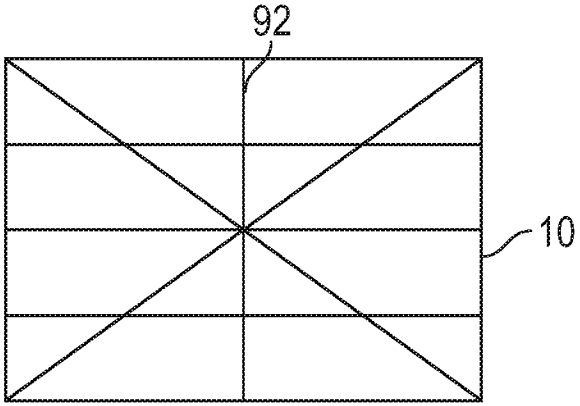
FIG. 23 shows another embodiment of a security liner that may stitched into the fabric of the collapsible lock box container.

FIG. 23 shows another embodiment of a security liner 92 that may stitched into the fabric of the collapsible lock box container 10, or may be applied to the outer or inner surface of the collapsible lock box container 10. This shows how the security may have a different design than the repeating diamond shape shown in FIG. 19.

Figure 24:
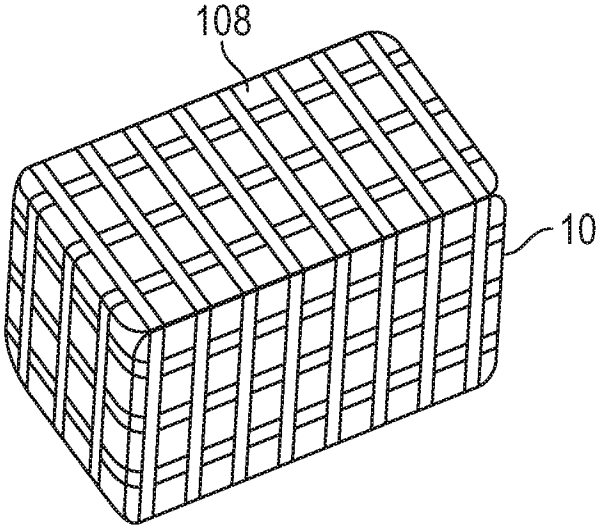
FIG. 24 shows a collapsible lock box container with a cabled webbing.

FIG. 24 shows the collapsible lock box container 10 with a cabled webbing 108 which can be used to create a grid like cargo net pattern which encompasses the collapsible lock box container 10.

Figure 25:
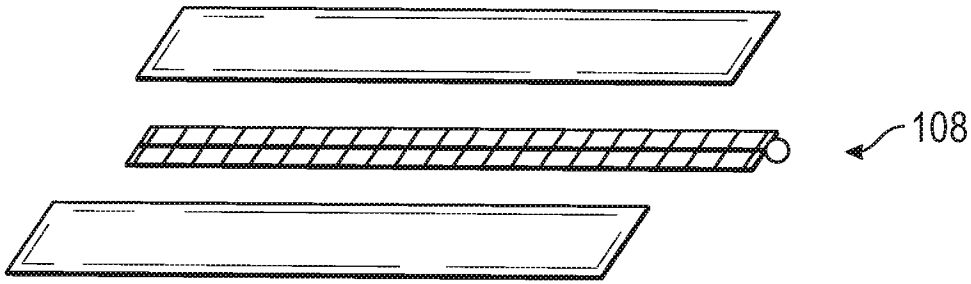
FIG. 25 shows the cabled webbing construction.

FIG. 25 shows the cabled webbing 108 construction.

Figure 26:
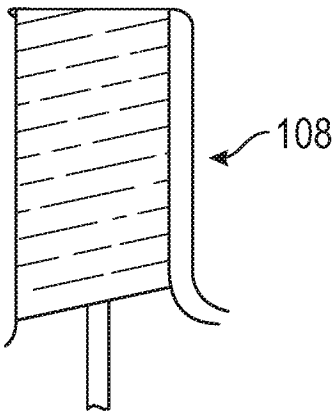
FIG. 26 shows the completed cable webbing with steel cable threaded either through or in between webbing.

FIG. 26 shows the completed cable webbing 108 with steel cable threaded either through or in between webbing.

Figure 27:
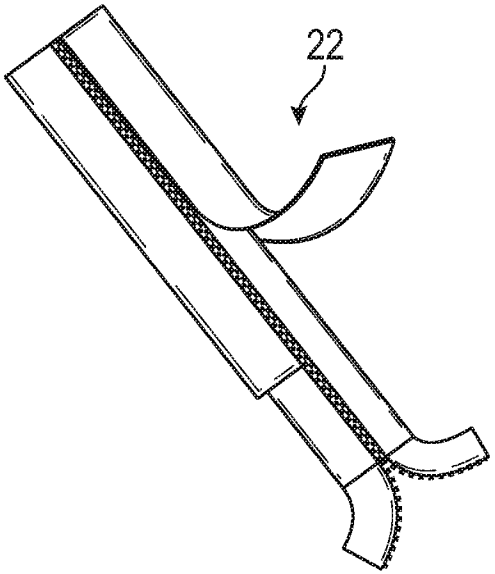
FIG. 27 shows one embodiment of the mechanical closing system construction using an additional top layer of a cut resistant material such as Kevlar on the zipper tape.
Figure 29A:
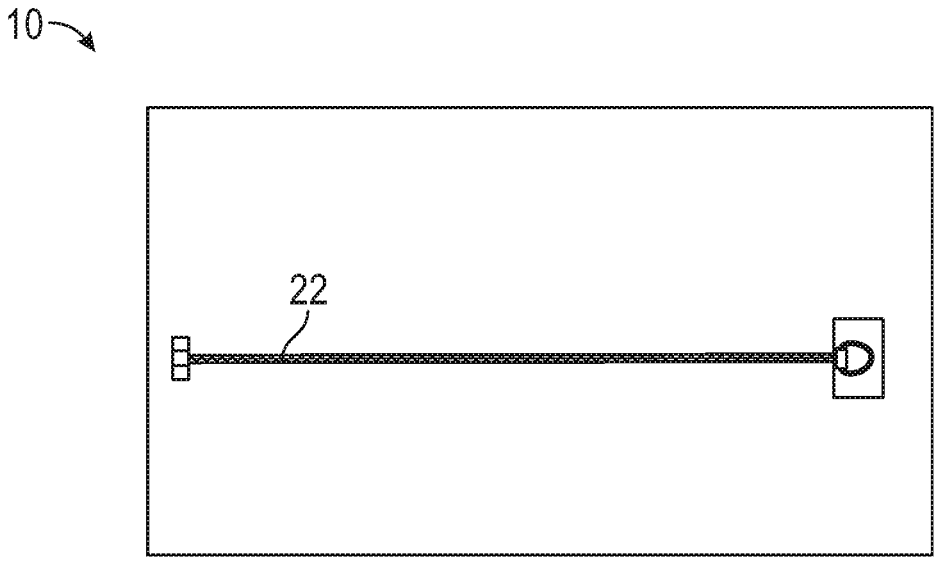
FIGS. 29A through 29E show how a variety of zipper patterns may be used in different embodiments of the collapsible lock box container.
Figure 29B:
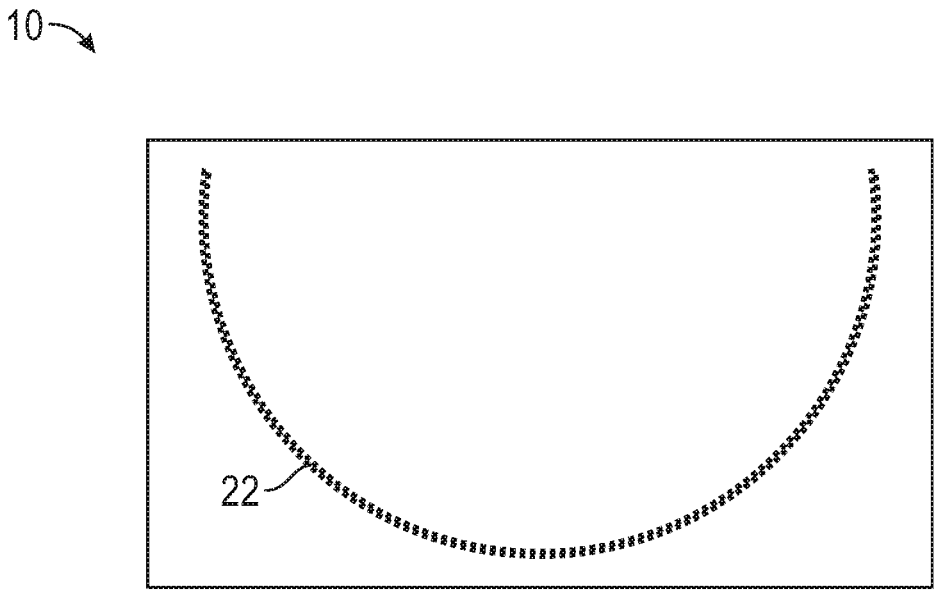
Figure 29C:
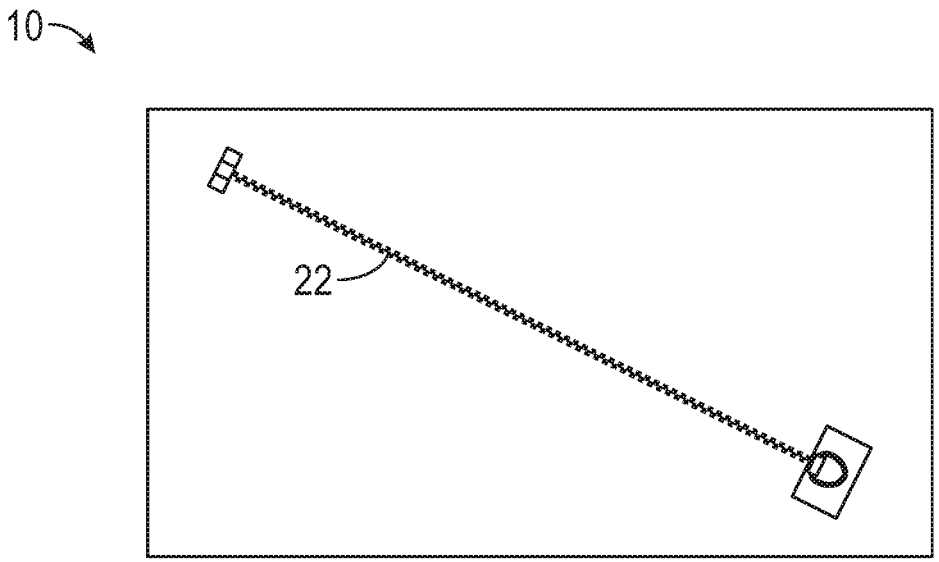
Figure 29D:
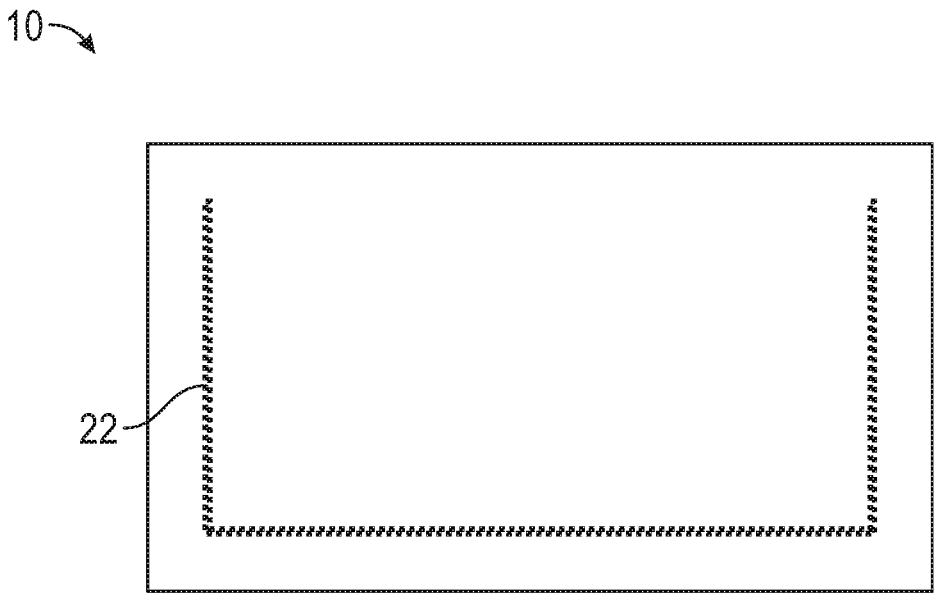

FIG. 27 shows one embodiment of the mechanical closing system 22, in this case a zipper with increased durability and cut protection may be used to overlay the zipper tape either on the bottom of the zipper tape or on top. This effectively will allow for increased security around the edges of the zipper.

Figure 28:
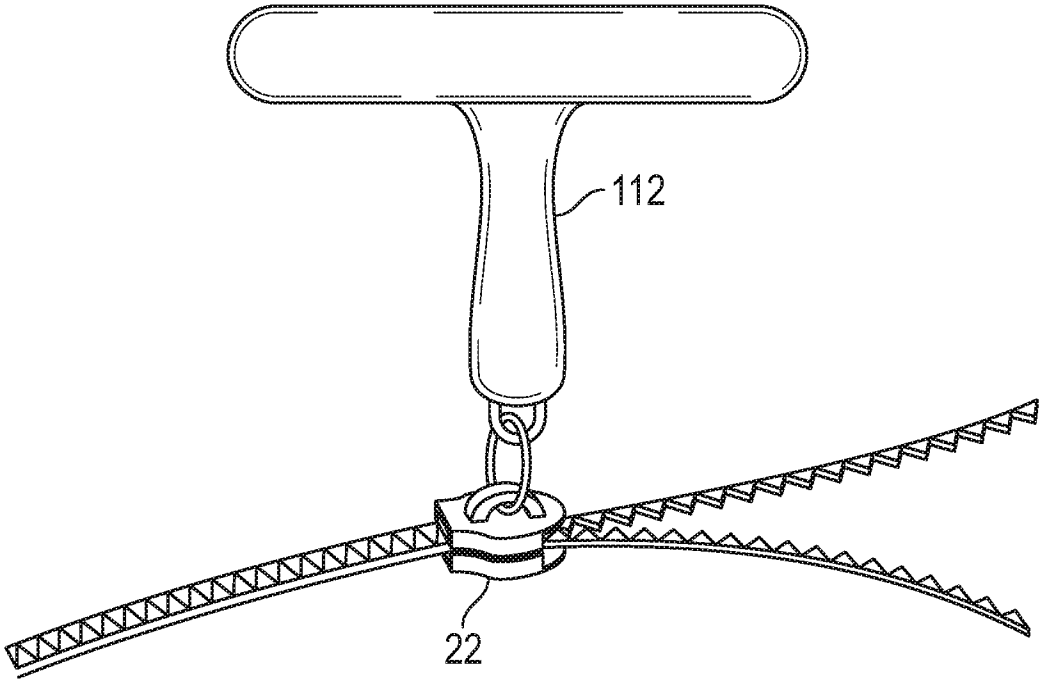
FIG. 28 shows one embodiment of a zipper handle.

FIG. 28 shows one embodiment of a zipper handle 112 for the mechanical closing system 22. To Increase usability and efficiency of the user, different styles of handles for the zippers slider can be used for more ergonomic uses.

FIGS. 29A through 29E show how a variety of zipper patterns may be used in different embodiments of the collapsible lock box container 10.

Figure 30:
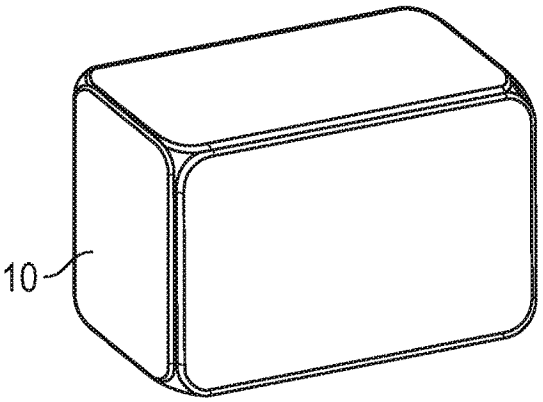
FIG. 30 shows one embodiment of the shape of the collapsible lock box container.

FIG. 30 shows one embodiment of the shape of the collapsible lock box container 10. Users may use any suitable alternative shape for the collapsible lock box container 10. Variations in dimensions to the collapsible lock box container 10 can be to specification to each individual user's needs depending on their type of use.

Figure 31:
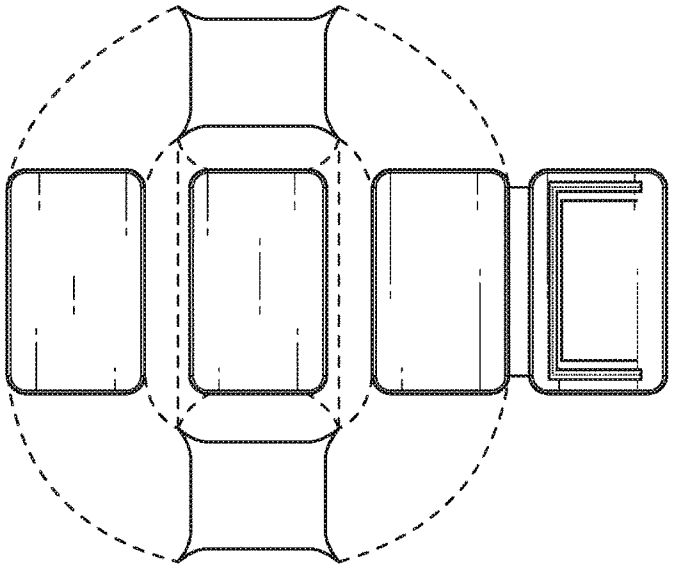
FIG. 31 shows the 6 panels that may make up the surfaces of the collapsible lock box container.

FIG. 31 shows the 6 panels that may make up the surfaces of the collapsible lock box container 10. Material may be cut out and shaped to fit the dimensions of the collapsible lock box container 10.

Figure 32:
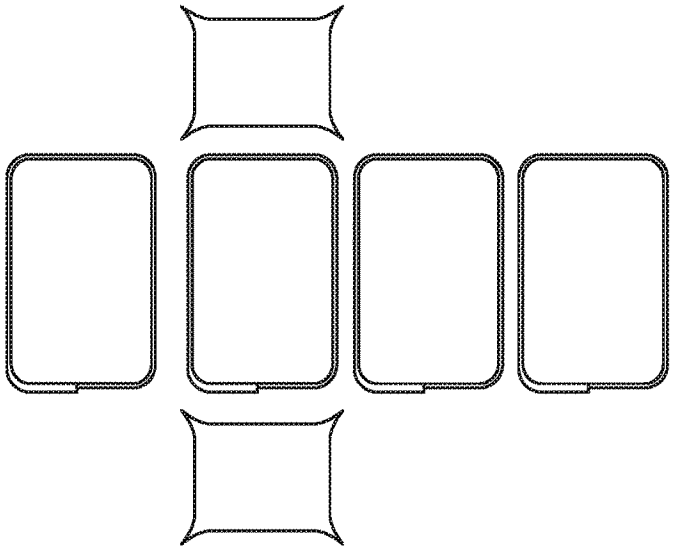
FIG. 32 shows how each panel may have a sleeve along the edges of the panel.
Figure 29E:
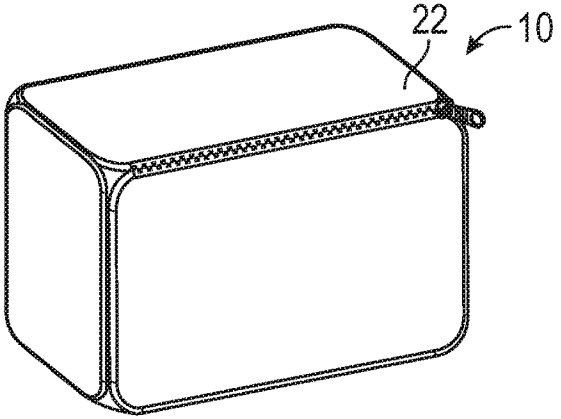

FIG. 32 shows how each panel may have a sleeve along the edges of the panel, configured to allow a spring back steel frame to slide in through the sleeves at the edge of each panel and then the frame ends be crimped in place. The sleeves of each panel may be what define the shape of the box as the spring back steel conforms to the gradual bends that the sleeves and the shell provide. Depending on the configuration and application of the outer shell, the sleeves may exist internally with the outer shell wrapping around the edges of the frame.

Figure 33:
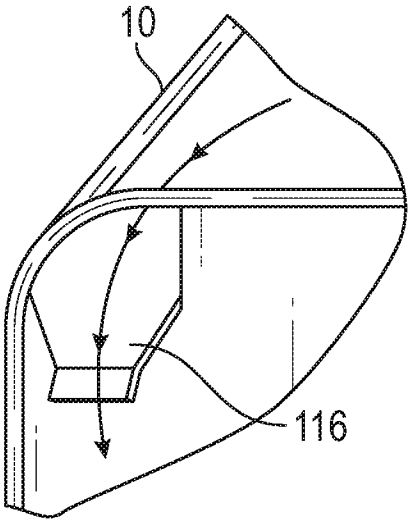
FIG. 33 shows one embodiment of a drain port.

The collapsible lock box container 10 may have a drain port 116 located on the topside of the container 10 for drainage of water as shown in FIG. 33. The drain port 116 is important as this will help prevent rain from pooling at the top of the collapsible lock box container 10 and leaking into it. The drain port 116 may be configured to have rain drain off to the side of the collapsible lock box container 10. One or more of these drain ports 116 may be used along the edges of the collapsible lock box container 10 to perform this function.

Figure 34:
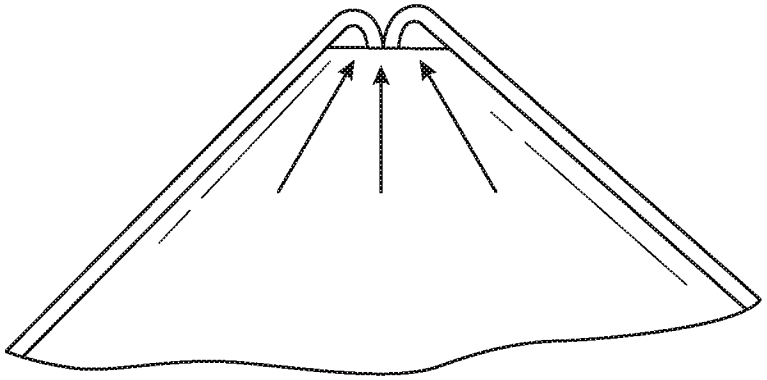
FIG. 34 shows an additional top view perspective of the drain port from FIG. 33.

FIG. 34 shows an additional top view of drain port from FIG. 33 with directional arrows to show the path of flow for water.

Figure 35:
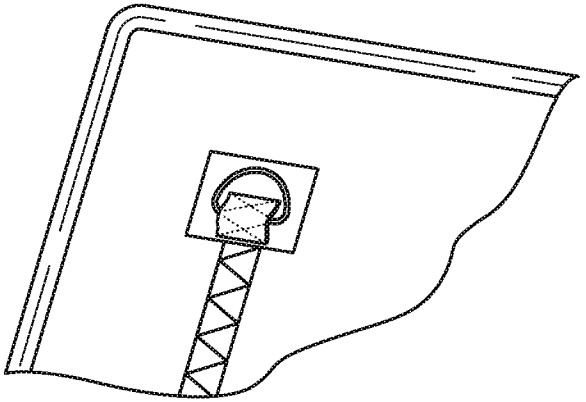
FIG. 35 shows an additional top view of drain port from FIG. 33.

FIG. 35 shows a top view of the drain port from FIG. 33.

Figure 36:
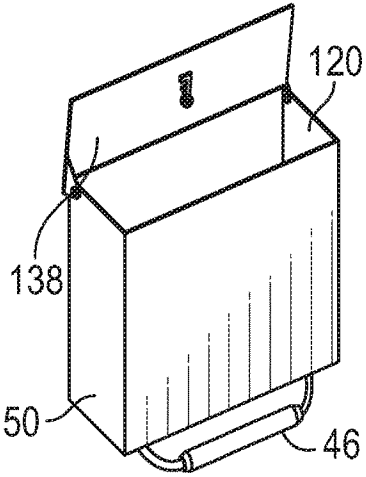
FIG. 36 is a perspective view of the storage container.

FIG. 36 is a perspective view of the storage container 50 which is configured to hold and allow a user to deploy the collapsible lock box container 10. In one embodiment, the storage container 50 may be configured to be wall mounted. The storage container 50 may have a first compartments 120 to hold mail, and a second compartment 124 to store the collapsible lock box container 10. The storage container 50 may have a pivotable lid 132, that can be pivoted about a pivot point to open or close the lid 132 with respect to the storage container 50.

Figure 37:
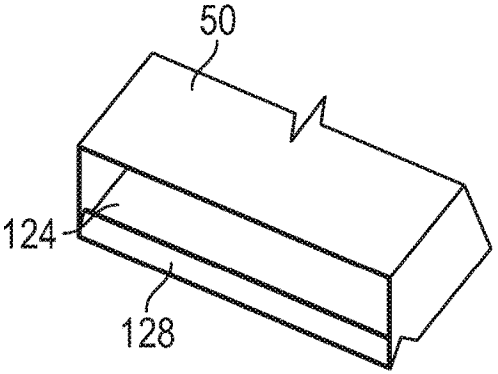
FIG. 37 is a bottom view of the storage container.

FIG. 37 is a bottom view of the storage container 50. In this view, a lip 128 is shown. The lip 128 is configured to help keep the collapsible lock box container 10 retained in the second compartment 124.

Figure 38:
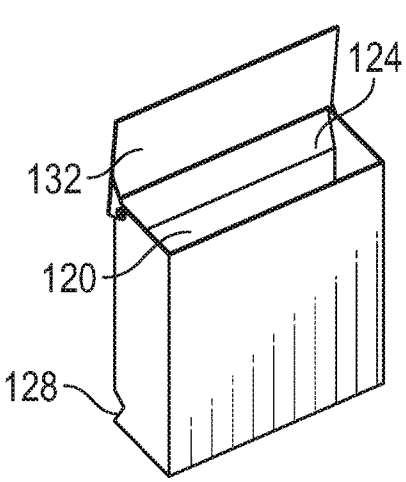
FIG. 38 is another perspective view of the storage container.

FIG. 38 is another perspective view of the storage container 50

Figure 39:
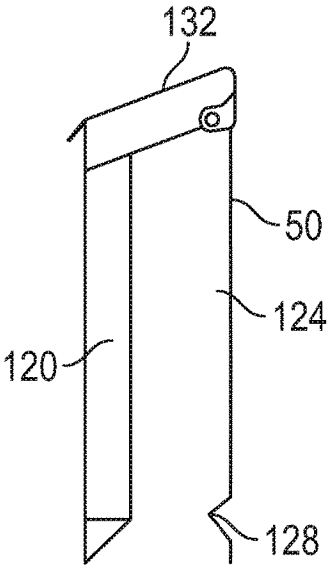
FIG. 39 is a side sectional view of the storage container.

FIG. 39 is a side sectional view of the container 50. In this view, the collapsible lock box container 10 has been removed.

Figure 40:
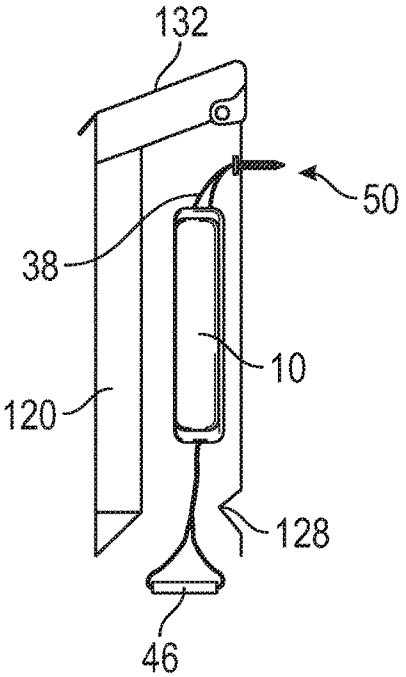
FIG. 40 is a side sectional view of the storage container with a collapsible lock box.

FIG. 40 is a side sectional view of the container 50 with the collapsible lock box container 10 located in the second compartment 124 in a folded and stored configuration.

Figure 41:
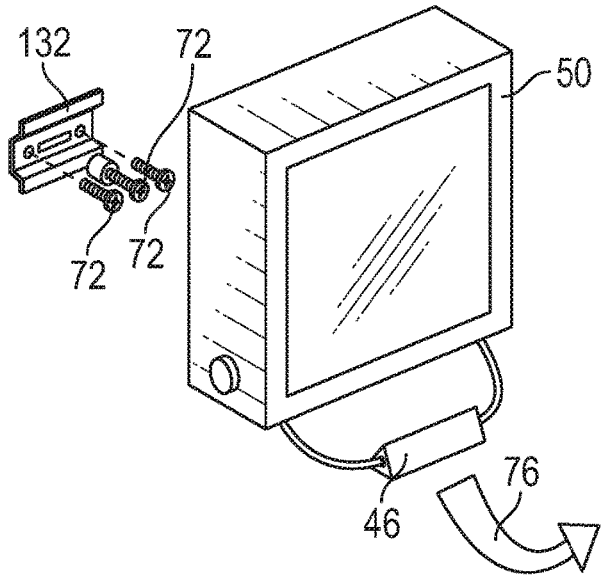
FIG. 41 shows a perspective view of the storage container with fasteners and wall attachment hardware.

FIG. 41 shows a perspective view of the storage container 50 with fasteners 72 and wall attachment hardware 132.

Figure 42:
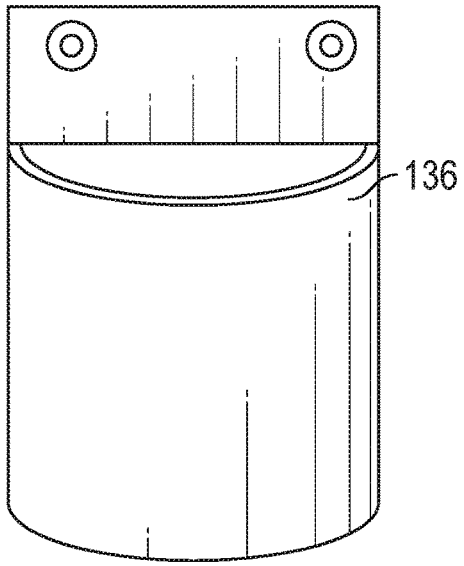
FIG. 42 shows a pouch style embodiment of the storage container.

FIG. 42 shows a pouch style embodiment of the storage container 136. The pouch style storage container 136 may provide cheaper alternatives and more versatility in terms of mounting. The pouch style storage container 136 may be hung on railings or be attached directly to poles or similar objects.

Figure 44:
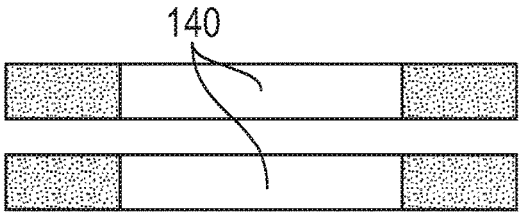
FIG. 44 is a top view of fastening straps.
Figure 43:
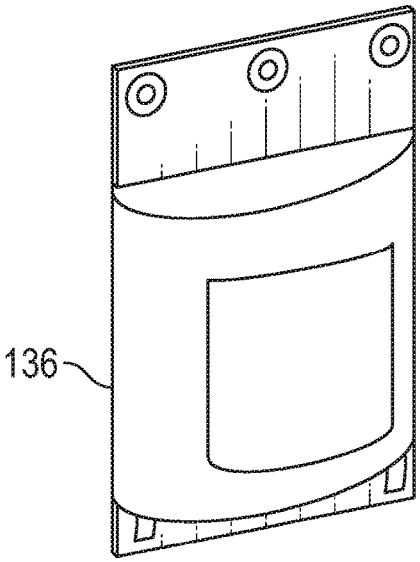
FIG. 43 shows another view of the pouch style storage container.
Figure 45:
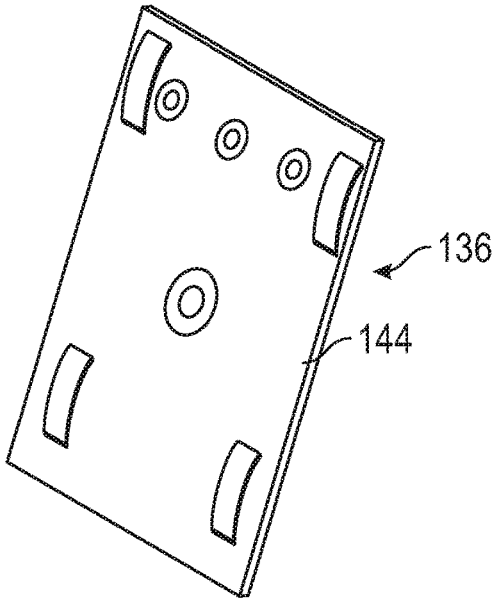
FIG. 45 is a rear view of the pouch style storage container.
Figure 46D:
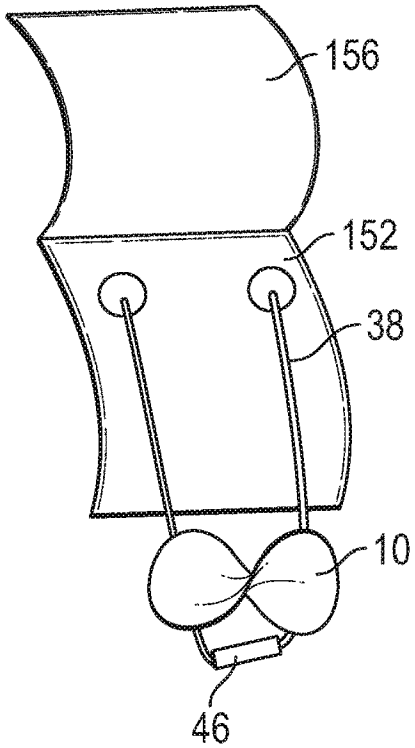
FIGS. 46A-46G show a fabric flap embodiment of the storage container.
Figure 46C:
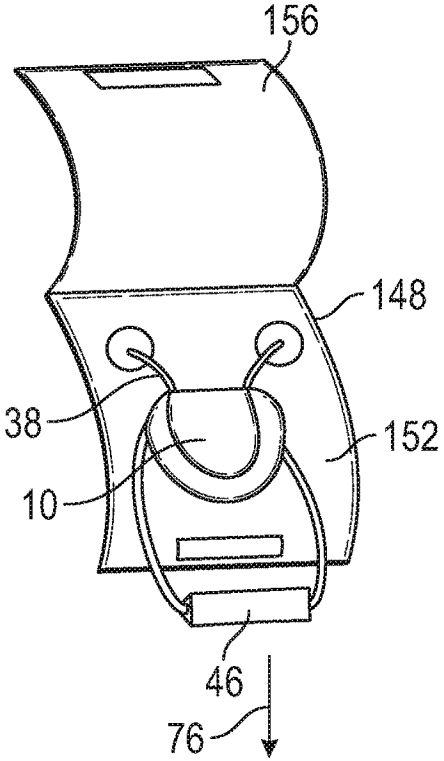
Figure 46B:
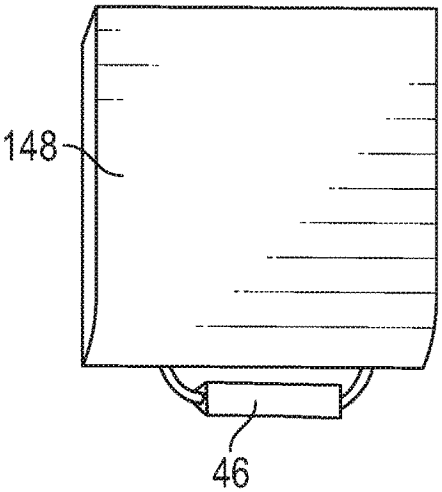
Figure 46A:
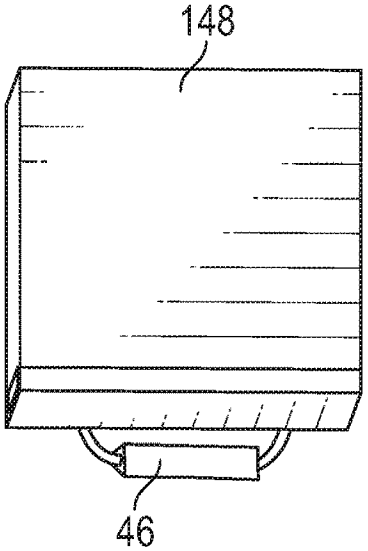
Figure 46G:
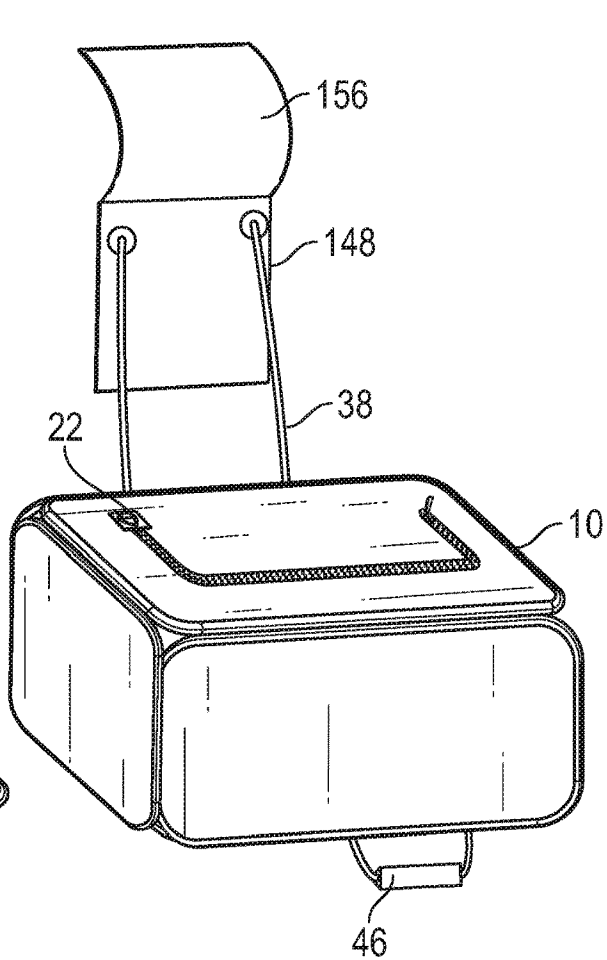
Figure 46F:
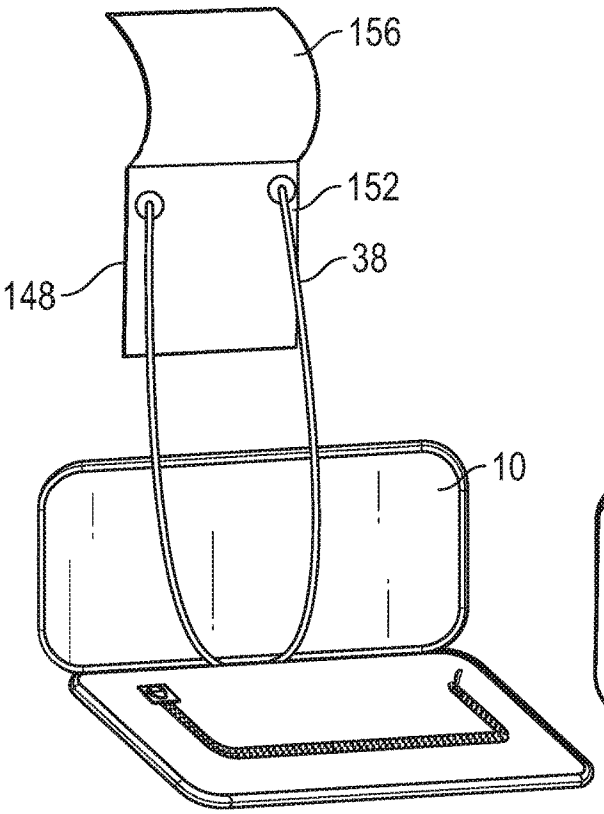
Figure 46E:
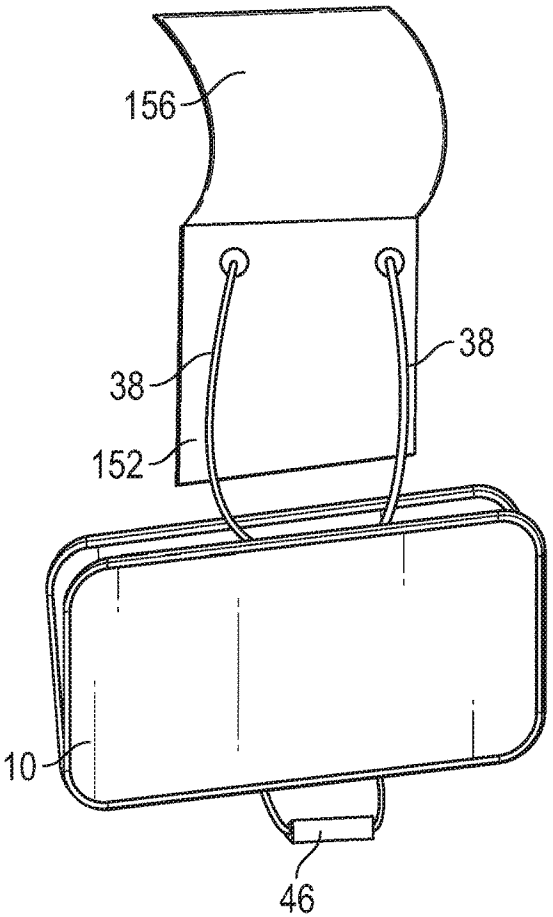

FIG. 43 shows another view of the pouch style storage container 136. The storage container 136 may include fastening straps 140, see FIG. 44, that are configured to loop on the back 144 of the storage container 136, see FIG. 45. The pouch style storage container 136 may include a stiff backing to increase rigidity for easier deployment, the backing may be plastic, metal, fiberglass or any suitable material.

FIGS. 46A-46G show another embodiment of the storage container 148. This container 148 provides an alternative to the pouch by providing a single back plate 152 with a fabric flap 156 in the front that overlays and contains collapsible lock box container 10 in its stored position. FIGS. 46B through 46G show how the collapsible lock box container 10 may be deployed.

Figure 48:
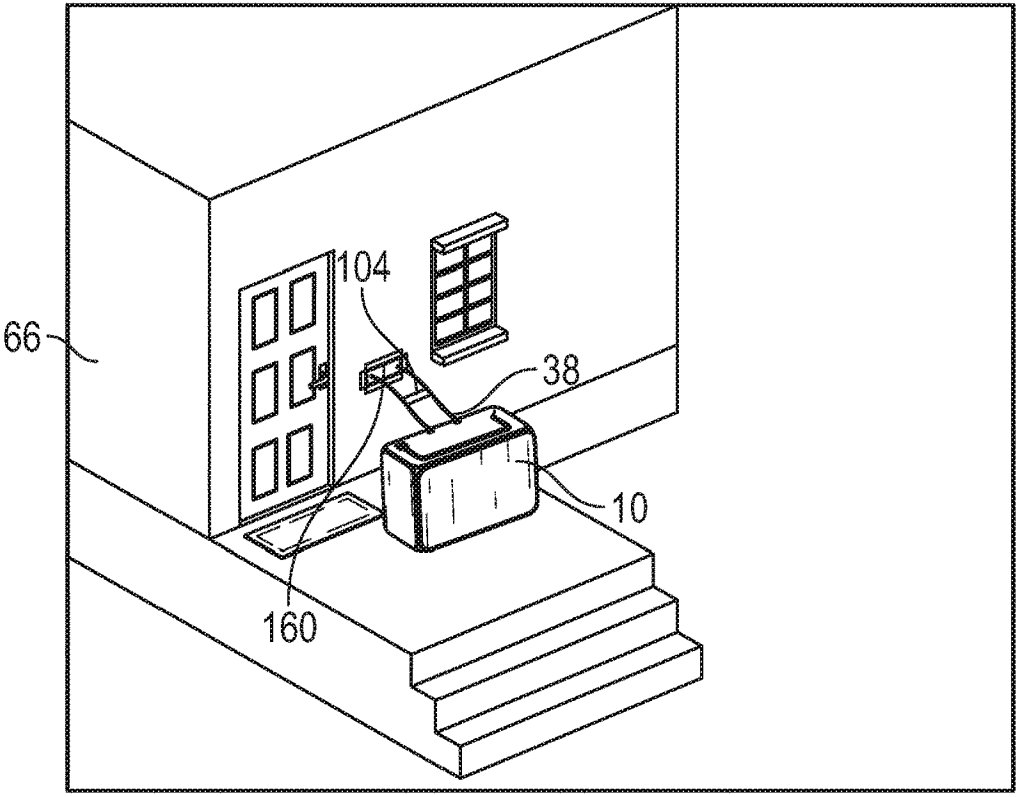
FIG. 48 shows the horizontal storage container attached to a house.
Figure 47:
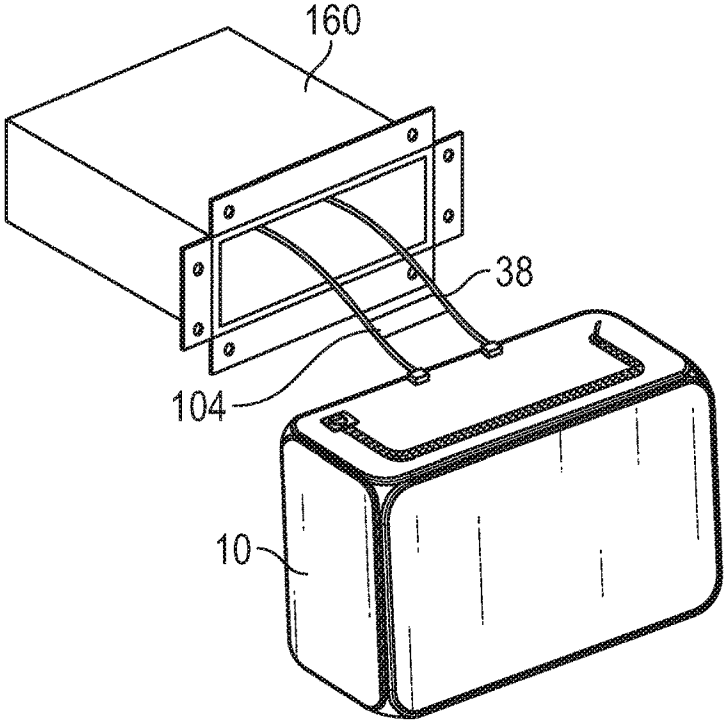
FIG. 47 shows an embodiment of a horizontal storage container with a deployed collapsible lock box container.
Figure 49:
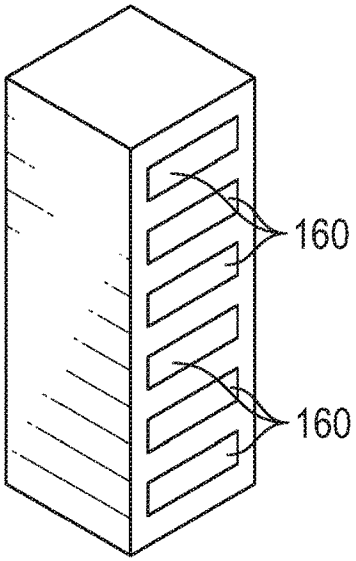
FIG. 49 shows a stacked orientation of storage containers.

FIG. 47 shows an embodiment of a horizontal storage container 160 with the deployed collapsible lock box container 10. This storage container 160 can be incorporated either in the side of buildings, used in a stacked formation vertically or horizontally. This provides the least minimal impact to an exterior view. FIG. 48 shows the horizontal storage container 160 attached to a house 66. FIG. 49 shows a stacked orientation of storage containers 160.

Figure 50:
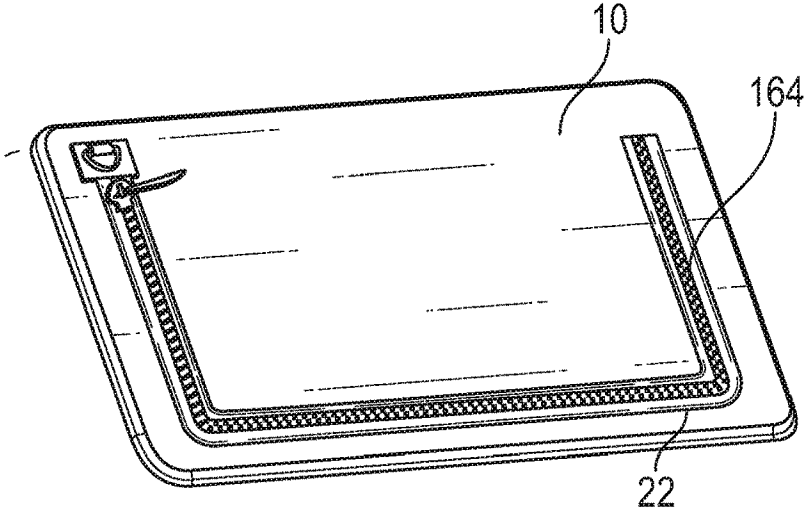
FIG. 50 shows an embodiment of a rain flap cover for a zipper.

FIG. 50 shows one embodiment of a rain flap cover 164 for the zipper 22. The rain flap cover is configured to cover the track of the zipper 22 to assist in weather proofing collapsible lock box container 10. The rain flap cover 164 may be made from similar materials to the outer shell or a combination of other materials.

Figure 51:
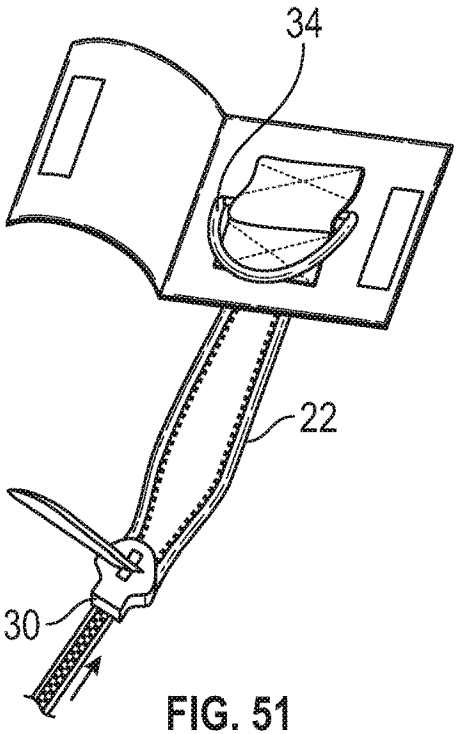
FIG. 51 is a close up view of the zipper and the secure ring shaped fixture.

FIG. 51 is a close up view of the zipper 22 and the secure ring shaped fixture 34, which in this embodiment may be a d-ring. The zipper slider 30 locks to the secure ring shaped fixture 34, which may be a d-ring or other similar fastening object that is secured to the outer shell with cabled cut resistant material. The zipper 22 itself may use a puncture resistant zipper to deter easy access to the collapsible lock box container 10.

The collapsible and pop up lock box with a mountable storage container and tether has many advantages. This invention directly prevents theft by denying access to the package itself and provides additional privacy. Additionally, the weather-resistant materials ensure that packages remain safe from environmental hazards, meeting both the security and protective needs of package delivery. The invention also offers an cost effective, scalable solution that can be adopted by individual homeowners, renters, and commercial properties alike. Its collapsible design and lightweight materials reduce production and shipping costs, making it accessible to a wider audience without sacrificing security or functionality. The combination of theft deterrence, weather protection, space efficiency, and case of use makes this invention a practical and innovative solution to the problem of unattended package deliveries. The Collapsible Pop-Up Lock Box with Mountable Storage Container and Tether is distinct from existing products and methods in several critical ways, providing a more comprehensive, efficient, and practical solution for last-mile delivery. The invention has collapsibility and space efficiency. The invention is made from lightweight and affordable materials. The invention has integrated theft deterrent features, such as the security tether system. The invention has weather-resistant and durable construction. The invention has case of use and deployment. The invention has an aesthetic and space-saving design. The invention is modular and adaptable for various uses. The invention also allows for easy upgrades or customizations, such as different sizes or configurations. This invention deploys in just seconds, respecting the demands and restraints of the delivery drivers. This invention provides familiar functionality which enhances its user experience. The invention provides convenience for those who are receiving packages by providing a secure method of drop off. This invention is adaptable to various housing types and can be implemented in a wide variety of places. It conforms to modern mainstream architecture provide a seamless aesthetic. This invention improves efficiency for delivery companies by providing a safe place for secure deliveries, reducing failed delivery which typically is very expensive for the delivery companies. This invention uses common materials and existing manufacturing processes for a simplified production process. This invention provides privacy for consumers by concealing their packages from unwanted attention. This invention aligns with eco-friendly initiatives to ship products without a shipping box by providing a safe place to store the package until it is ready to be picked up by the consumer. This invention provides various bundling opportunities with other smart home devices. This invention provides an opportunity to customize dimensions to various sizes to meet the demands of each individual user. The invention provides versatile uses that do not relate to just package delivery. This invention provides a unique in-store opportunity for Brick-and-Mortar stores to bring one of the most compact lock boxes for packages on the market, bringing in a new product line without the demands of taking up too much shelf space.

It should be noted that the terms "first", "second", and "third", and the like may be used herein to modify elements performing similar and/or analogous functions. These modifiers do not imply a spatial, sequential, or hierarchical order to the modified elements unless specifically stated.

Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A system to protect delivered items, the system comprising:

a storage container;

a collapsible lock box container, the collapsible lock box container comprising a frame, wherein the frame is configured to be folded when inside the storage container, and when folded, the frame is in tension ready to unfold and expand, but is configured to remain folded when inside the storage container;

a tether attached to the storage container and the collapsible lock box container;

wherein the collapsible lock box container is configured to automatically deploy from a folded stored configuration with a minimum volume when inside the storage container, to an unfolded and expanded configuration with a maximum volume due to the frame automatically unfolding and expanding into the maximum volume when removed from the storage container, and is ready to accept a delivered item when the collapsible lock box container is removed from the storage container.

2. The system of claim 1, wherein the collapsible lock box container is made from cut and tamper proof material, and the tether is made from cut and tamper proof material.

3. The system of claim 1, wherein the collapsible lock box container comprises:

a zipper with a zipper slide;

a flap configured to be opened or closed via the zipper and further configured to allow the depositing of a delivered item into the collapsible lock box container when in the unfolded and expanded configuration;

a secure ring shaped fixture located adjacent to the zipper;

a lock attachable to the zipper slide and secure ring;

wherein the zipper slide is configured to be locked via the lock to the secure ring shaped fixture thus preventing opening of the zipper and the flap unless a user has a means to unlock the lock.

4. The system of claim 3 wherein the secure ring shaped fixture is connected to the collapsible lock box container at reinforced anchor points.

5. The system of claim 1, wherein the storage container is permanently attached to a building or to a permanent fixture on or near the building.

6. The system of claim 1, wherein the frame is made from a flexible metal material.

7. The system of claim 1, wherein a surface of the collapsible lock box container comprises a tear and cut resistant netting or cable mesh.

8. The system of claim 1, wherein the tether is made from braided metal.

9. The system of claim 1, wherein the tether is connected to the collapsible lock box container at reinforced anchor points.

10. The system of claim 1, wherein the collapsible lock box container comprises a sturdy stitched handle configured to extend from and exterior to the storage container when the collapsible lock box container is located in the storage container.

* * * * *